US009449572B2

(12) United States Patent
Yoshimoto

(10) Patent No.: US 9,449,572 B2
(45) Date of Patent: Sep. 20, 2016

(54) ELECTRO-OPTICAL DEVICE AND ELECTRONIC APPARATUS HAVING COMPENSATION UNIT FOR PERFORMING VOLTAGE COMPENSATION

(71) Applicant: Seiko Epson Corporation, Tokyo (JP)

(72) Inventor: Hiroshi Yoshimoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 80 days.

(21) Appl. No.: 13/666,025

(22) Filed: Nov. 1, 2012

(65) Prior Publication Data

US 2013/0113778 A1 May 9, 2013

(30) Foreign Application Priority Data

Nov. 8, 2011 (JP) ..... 2011-244481

(51) Int. Cl.
*G09G 3/36* (2006.01)

(52) U.S. Cl.
CPC ..... *G09G 3/3648* (2013.01); *G09G 3/3614* (2013.01); *G09G 3/3655* (2013.01); *G09G 2320/0204* (2013.01); *G09G 2320/0219* (2013.01)

(58) Field of Classification Search
CPC ..... G09G 2300/0421–2300/0434; G09G 2310/0264–2310/0281
USPC ..... 345/87–104
See application file for complete search history.

(56) References Cited

U.S. PATENT DOCUMENTS

2002/0089477 A1 7/2002 Kanbe et al.
2006/0017686 A1* 1/2006 Park ..... 345/100
2006/0033696 A1 2/2006 Nakamura et al.
2006/0267914 A1* 11/2006 Chang et al. ..... 345/100
2006/0290630 A1* 12/2006 Kim ..... H01L 27/1296 345/92
2007/0024560 A1* 2/2007 Kim ..... G09G 3/3614 345/94
2008/0180374 A1 7/2008 Yoshimoto
2008/0224983 A1* 9/2008 Lee et al. ..... 345/98
2008/0284697 A1* 11/2008 Nam ..... G02F 1/1345 345/87
2008/0284969 A1* 11/2008 Lim ..... 349/152
2010/0053125 A1* 3/2010 Kim et al. ..... 345/204
2010/0245700 A1* 9/2010 Zhao et al. ..... 349/48
2010/0253610 A1* 10/2010 Lee et al. ..... 345/92
2011/0221719 A1* 9/2011 Kim ..... G09G 3/3648 345/205

FOREIGN PATENT DOCUMENTS

JP 64-076034 A 3/1989
JP 11-153981 A 6/1999
JP 2002-189460 A 7/2002
JP 2003-255909 A 9/2003

(Continued)

*Primary Examiner* — Sanghyuk Park
(74) *Attorney, Agent, or Firm* — ALG Intellectual Property, LLC

(57) ABSTRACT

Provided is an electro-optical device including a first pixel group in which is written into each pixel electrode of the first pixel group via a first wiring in a first path, a second pixel group in which is written into each pixel electrode of the second pixel group via a second wiring in a second path, an common electrode that is common to the first pixel group and the second pixel group, and a compensation unit performing compensation on at least one of a voltage supplied to the first pixel group via the first wiring and a voltage supplied to the second pixel group via the second wiring, in such a manner as to reduce a difference between an optimal voltage of the common electrode with respect to the first pixel group and an optimal voltage of the common electrode with respect to the second pixel group.

6 Claims, 14 Drawing Sheets

(56) References Cited

FOREIGN PATENT DOCUMENTS

| | | | |
|---|---|---|---|
| JP | 2006-53428 | A | 2/2006 |
| JP | 2006-220787 | A | 8/2006 |
| JP | 2008-122633 | A | 5/2008 |
| JP | 2008-185993 | A | 8/2008 |
| JP | 2009-175563 | A | 8/2009 |
| JP | 2009-192877 | A | 8/2009 |
| WO | WO-2007-052421 | A | 5/2007 |

* cited by examiner

ELECTRO-OPTICAL DEVICE AND ELECTRONIC APPARATUS HAVING COMPENSATION UNIT FOR PERFORMING VOLTAGE COMPENSATION

BACKGROUND

1. Technical Field

The present invention relates to a technology that reduces display defects, such as flickering and screen burn in an electro-optical device.

2. Related Art

A liquid crystal display is a device that modulates transmitted light or reflected light to display an image by controlling a voltage applied to a liquid crystal for every pixel and controlling the transmissivity or reflectivity of the liquid crystal. In the liquid crystal display, a voltage applied to the liquid crystal is controlled by the liquid crystal being interposed between a pixel electrode provided with respect to each pixel and an common electrode common to the pixels and by a voltage being controlled between each pixel electrode and the common electrode. In an active-matrix-type liquid crystal device, each pixel electrode is connected to a signal line (referred to as a data line) via a corresponding switching element (usually known as a field effect transistor, but hereinafter referred to as a transistor for short) and a potential according to the potential supplied to the signal line (referred to as a display signal) is written into the pixel electrode when the transistor is in an ON state. The potential of an common electrode is usually controlled in such a manner as to become a mostly constant potential. Moreover, the potential of each component of the liquid crystal display is expressed by a potential difference (a voltage) between that potential and the potential defined as a reference (for example, ground potential). Therefore, in the following description, potential and voltage are used to have the same meaning.

In the liquid crystal display, an alternating current drive that periodically changes the polarity of the voltage applied to the liquid crystal is performed because deterioration in the liquid crystal occurs when a direct current voltage is applied to the liquid crystal for a long time. A state where the potential of the pixel electrode is higher than the potential of the common electrode is referred to as a state where a voltage with a positive polarity is applied to the liquid crystal, and a state where the potential of the pixel electrode is lower than the potential of the common electrode is referred to as a state where a voltage with a negative polarity is applied to the liquid crystal. In the alternating current drive, a signal in which the positive polarity and the negative polarity appear alternately (for example, every frame) is supplied with respect to a predetermined central potential, as a display signal supplied to the data line, and the potential of the common electrode is set in such a manner as to usually match the central potential of the display signal.

It is known that a phenomenon called feed-through occurs in the liquid crystal display described above. Feed-through is a phenomenon where the potential of the pixel electrode is changed from the potential that is written when the transistor is in a ON state, when the transistor changes from in an ON state to in an OFF state, due to a parasitic capacity between a gate electrode of the transistor and an electrode (for example, a drain electrode) connected to the pixel electrode. The direction in which the potential of the pixel electrode is changed by the feed-through is a constant direction (is the downward direction when the transistor is an N-channel type and is the upward direction when the transistor is a P-channel type), regardless of the value of the potential written into the pixel electrode. Because of this, the central potential of the pixel electrode deviates only by the potential change due to feed-through, from the central potential of the display signal supplied onto a signal line. Therefore, the direct current voltage component acts on the liquid crystal, by the potential of the pixel electrode being changed due to feed-through, in a case where the potential of the common electrode is set in such a manner as to match the central potential of the display signal supplied to the signal line. In other words, an unbalance occurs in the voltage with the positive polarity and the voltage with the negative polarity which are applied to the liquid crystal. This becomes a cause of the occurrence of deterioration in the liquid crystal, screen burn, and flickering and the like. JP-A-2002-189460 discloses that the potential of the common electrode is shifted from the central potential of the display signal only by the potential change in the pixel electrode due to feed-through.

JP-A-2009-175563 discloses that two signal lines are arranged in such a manner as to at least partly overlap each other via an insulation film (that is, multi-layer wiring is performed), in the liquid crystal display having the two signal lines with respect to each pixel column. In each pixel column, the pixels in the odd-numbered rows are connected to one of the two signal lines via the transistor, and the pixels in the even-numbered rows are connected to the other of the two signal lines via the transistor. The pixels in the odd-numbered rows and the pixels in the even-numbered rows are different in terms of the area of the pixel electrode and one composite pixel is formed by a pair of pixels adjacent to each other in the column direction.

The optimal potential of the common electrode (a opposing electrode) may differ in the pixels in the even-numbered row and the pixels in the odd-numbered row, in the liquid crystal display disclosed in JP-A-2009-175563. Because of this, for example, when the potential of the common electrode is set in such a manner as to be of an optimal value with respect to the pixels in the odd-numbered row, the potential of the common electrode is not of an optimal value with respect to the pixels in the even-numbered row. As a result, the unbalance may occur in the voltage with the positive polarity and the voltage with the negative polarity that are applied to the liquid crystal and defects such as deterioration in the liquid crystal, screen burn, and flickering may occur.

SUMMARY

An advantage of some aspects of the invention is to reduce display defects in an electro-optical device including pixel groups to which a voltage is applied via wiring in different paths.

According to an aspect of the invention, there is provided an electro-optical device including a first pixel group in which a voltage is written into each pixel electrode according to a voltage supplied to the first pixel group via wiring in a first path, a second pixel group in which a voltage is written into each pixel electrode according to a voltage supplied to the second pixel group via wiring in a second path, an common electrode that is common to the first pixel group and the second pixel group, and a compensation unit that performs compensation on at least one of a voltage supplied to the first pixel group via the wiring in the first path and a voltage supplied to the second pixel group via the wiring in the second path, in such a manner as to reduce a difference between an optimal voltage of the common electrode with respect to the first pixel group and an optimal voltage of the common electrode with respect to the second pixel group.

According to this electro-optical device, the display defects are reduced in the electro-optical device including the pixel groups to which the voltage is applied via the wiring in the different paths, compared with a case where the electro-optical device has no compensation unit that performs compensation on at least one of a voltage supplied to the first pixel group via the wiring in the first path and a voltage supplied to the second pixel group via the wiring in the second path in such a manner as to reduce the difference between the optimal voltage of the common electrode with respect to the first pixel group and the optimal voltage of the common electrode with respect to the second pixel group.

In the aspect of the invention, the wiring in the first path and the wiring in the second path may be arranged in different layers via an insulator.

According to this electro-optical device, the wiring in the first path and the wiring in the second path are easy to arrange, compared with a case where the wiring in the first path and the wiring in the second path are not arranged in the different layers via an insulator.

In the aspect of the invention, the wiring in the first path and the wiring in the second path may be driven by different drive circuits.

According to this electro-optical device, the speed at which the voltage is written into the pixel is improved, compared with a case where the wiring in the first path and the wiring in the second path are not driven by the different circuits.

In the aspect of the invention, the compensation unit may include a compensation circuit that performs compensation on image data determining a grayscale level of at least one of the first pixel group and the second pixel group, and a D/A converter that performs D/A conversion on the image data on which compensation is performed by the compensation circuit and generates the voltage to be supplied to at least one of the first pixel group and the second pixel group.

According to this electro-optical device, compensation on the voltage to be applied to at least one of the first pixel group and the second pixel group may be performed with high precision compared with the case where the compensation unit has no compensation circuit and the D/A conversion circuit.

Moreover, according to another aspect of the invention, there is provided an electronic apparatus equipped with the electro-optical device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment

Figure 1:
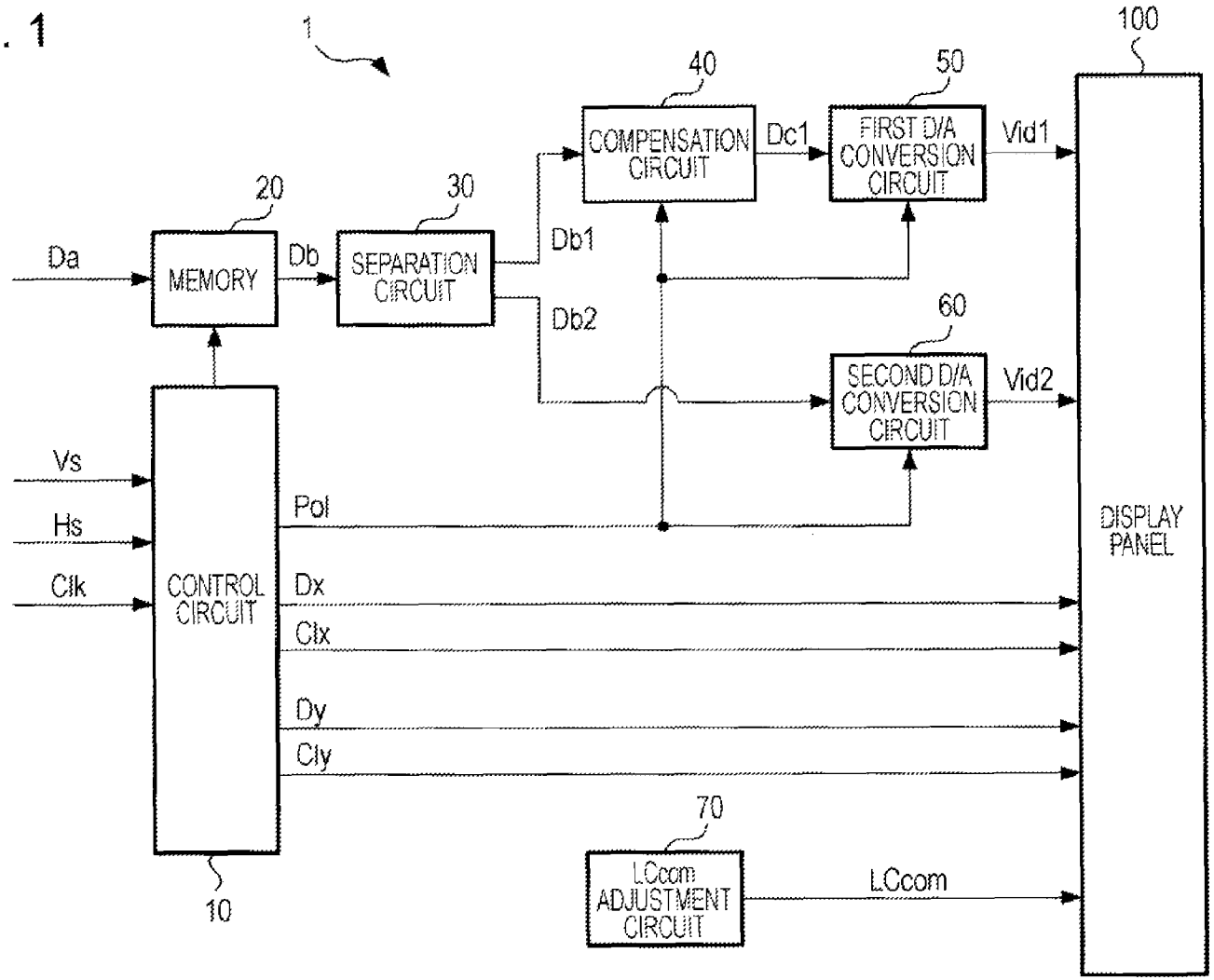
FIG. 1 is a block diagram illustrating a configuration of an electro-optical device according to an embodiment.

FIG. 1 is a block diagram illustrating a configuration of an electro-optical device 1 according to one embodiment of the invention. As illustrated in FIG. 1, the electro-optical device 1 has a configuration that includes a control circuit 10, a memory device 20, a separation circuit 30, a compensation circuit 40, a first D/A conversion circuit 50, a second D/A conversion circuit 60, an LCcom adjustment circuit 70, and a display panel 100.

The control circuit 10 generates a horizontal scan clock signal Clx, a vertical scan clock signal Cly, and various control signals, and controls each component, based on a vertical synchronization signal Vs, a horizontal synchronization signal Hs, and a dot clock signal Clk which are supplied from an external higher-level device (not shown). In the control signal, there are included a polarity designation signal Pol that designates the polarity of data writing in a first field and a second field that are described below and start pulses Dx and Dy that instruct the starting of horizontal and perpendicular direction scans, respectively.

Image data Da is synchronized with the vertical synchronization signal Vs, the horizontal synchronization signal Hs and the dot clock signal Clk from the higher-level apparatus whose illustration is omitted, and is repeatedly supplied to the electro-optical device 1, per frame unit. At this point, the frame refers to each of the still images that make up an image, and for example, the image data Da corresponding to one frame is supplied with a period of 1/60 seconds (approximately 16.7 milliseconds), in a case where the image includes the still images that are 60 frames per second. The image data Da are, for example, 8-bit digital data with respect to each pixel of the display panel 100, and a shade (a grayscale level) of each pixel is designated using a 256 grayscale range from the darkest value of "0" to the brightest value of "255". The image data Da may be post-gamma-compensation data.

The memory device 20 has a storage area corresponding to each pixel of the display panel 100. According to instructions from the control circuit 10, the image data Da on the pixel corresponding to each storage area is stored in each of the storage areas of the memory device 20. Furthermore, in the present embodiment, one frame is divided into the two fields (the first field and the second field) and one frame of image data Da that is written into the memory device 20 is completely read out as image data Db twice, in the first field and the second field, according to a write scan in the display panel 100.

The separation circuit 30 divides the image data Db read out from the memory device 20 into the image data Db1 for the pixels in the odd-numbered row (hereinafter referred to as the odd-numbered row image data Db1) and the image data Db2 for the pixels in the even-numbered row (hereinafter referred to as the even-numbered row image data Db2). The compensation circuit 40 applies compensation to the odd-numbered row image data Db1 and generates odd-numbered row image data Dc1 on which compensation is performed, as described below. The first D/A conversion circuit 50 converts the odd-numbered row image data Dc1, on which compensation is performed, to an odd-numbered row voltage signal Vid1 of a voltage that is a voltage according to the grayscale level, and that has a polarity designated by the polarity designation signal Pol and supplies the result to the display panel 100. The second D/A conversion circuit 60 converts the even-numbered row image data Db2 output from the separation circuit 30 to an even-numbered row voltage signal Vid2 of a voltage that is a voltage according to the grayscale level, and that has a polarity designated by the polarity designation signal Pol and supplies the result to the display panel 100. The compensation circuit 40 and the first D/A conversion circuit 50 are equivalent to one example of a compensation unit according to the invention.

The LCcom adjustment circuit 70 supplies, for example, a voltage LCcom of an common electrode, which is adjusted based on a user's direction input through a manipulation unit (for example, a keyboard etc) of which an illustration is omitted, to the display panel 100.

Figure 2:
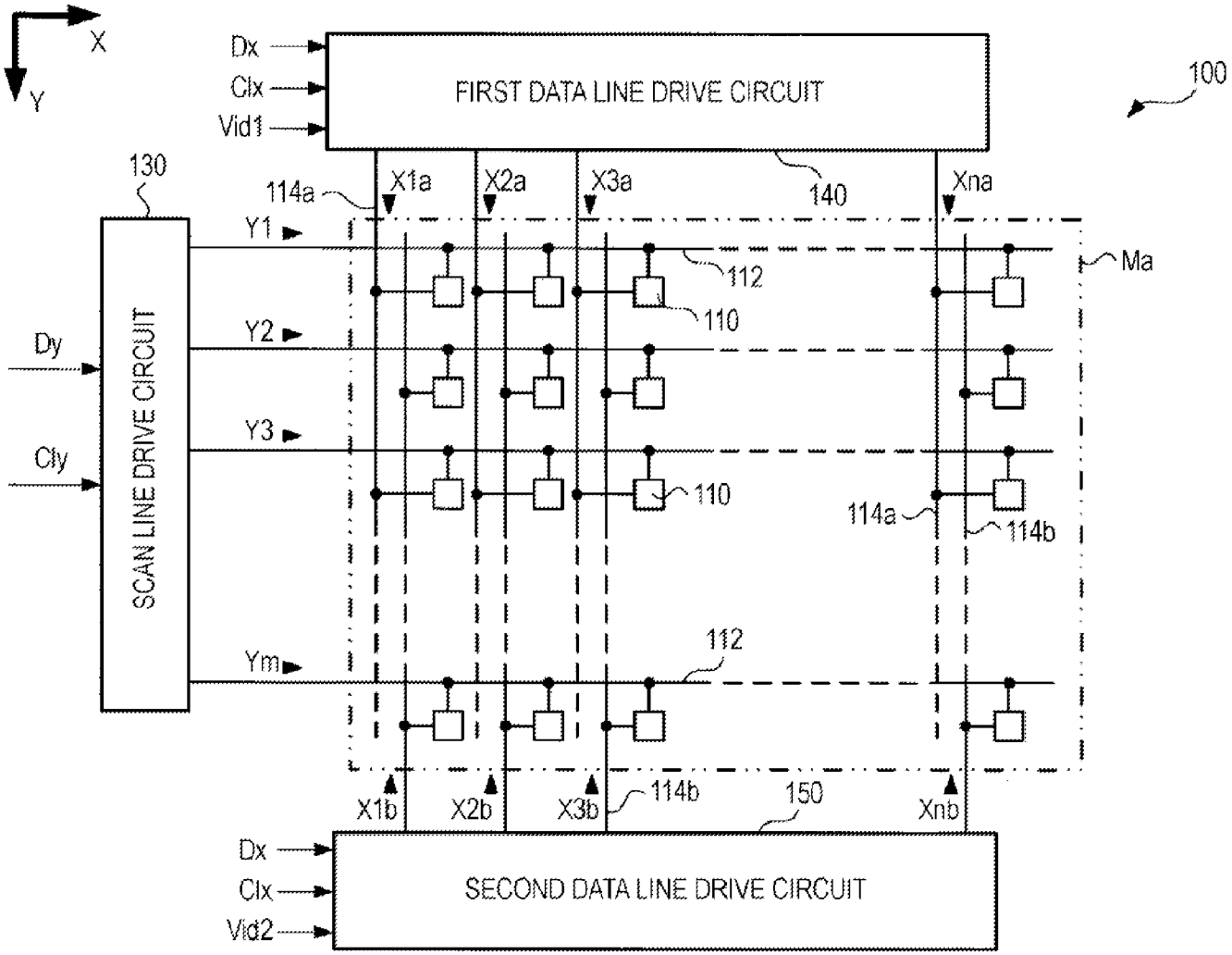
FIG. 2 is a view illustrating a configuration of a display panel of the electro-optical device.

FIG. 2 is a view illustrating a configuration of the display panel 100. As illustrated in FIG. 2, the display panel 100 is a type with built-in peripheral circuits in which a scan line drive circuit 130, a first data line drive circuit 140 and a second data line drive circuit 150 are built into the vicinity of a display area Ma where pixels 110 are arranged in the form of a matrix with m rows and n columns. The value of the row number m is, for example, 2160, and the value of the column number n is, for example, 4096, but the values are not limited to these numbers. A pixel in the p-th row and q-th column is expressed as a pixel (p, q).

In the display area Ma, a scan line 112 is provided in such a manner as to correspond to each row of the pixels 110 and extend in the row direction (the X direction), and a data line 114 is provided in such a manner as to correspond to each column of the pixels 110 and extend in the column direction (the Y direction). The scan line 112 and the data line 114 are provided in such a manner as to maintain electrical insulation from each other. Each pixel 110 is arranged corresponding to an intersection at which the scan line 112 and the data line 114 intersect.

In the present embodiment, one scan line 112 is provided to each row of the pixels 110, and the pixels 110 in each row are connected to the corresponding scan line 112. On the other hand, two data lines 114 are provided with respect to each column of the pixels 110. The pixels 110 positioned in the odd-numbered row among the pixels 110 in each column of the pixels are connected to one, namely a data line 114*a*, (hereinafter referred to as an odd-numbered row data line 114*a*) of the two data lines 114 corresponding to such a column of the pixels, and the pixels 110 positioned in the even-numbered row are connected to the other, namely a data line 114*b*, (hereinafter referred to as an even-numbered row data line 114*b*) of the two data lines 114 corresponding to such a column of the pixels. The pixels 110 positioned in the odd-numbered row are an example of a first pixel group to which a voltage is applied via wiring of a first path according to the invention, and the pixels 110 positioned in the even-numbered row are an example of a second pixel group to which a voltage is applied via wiring of a second path according to the invention.

Figure 3:
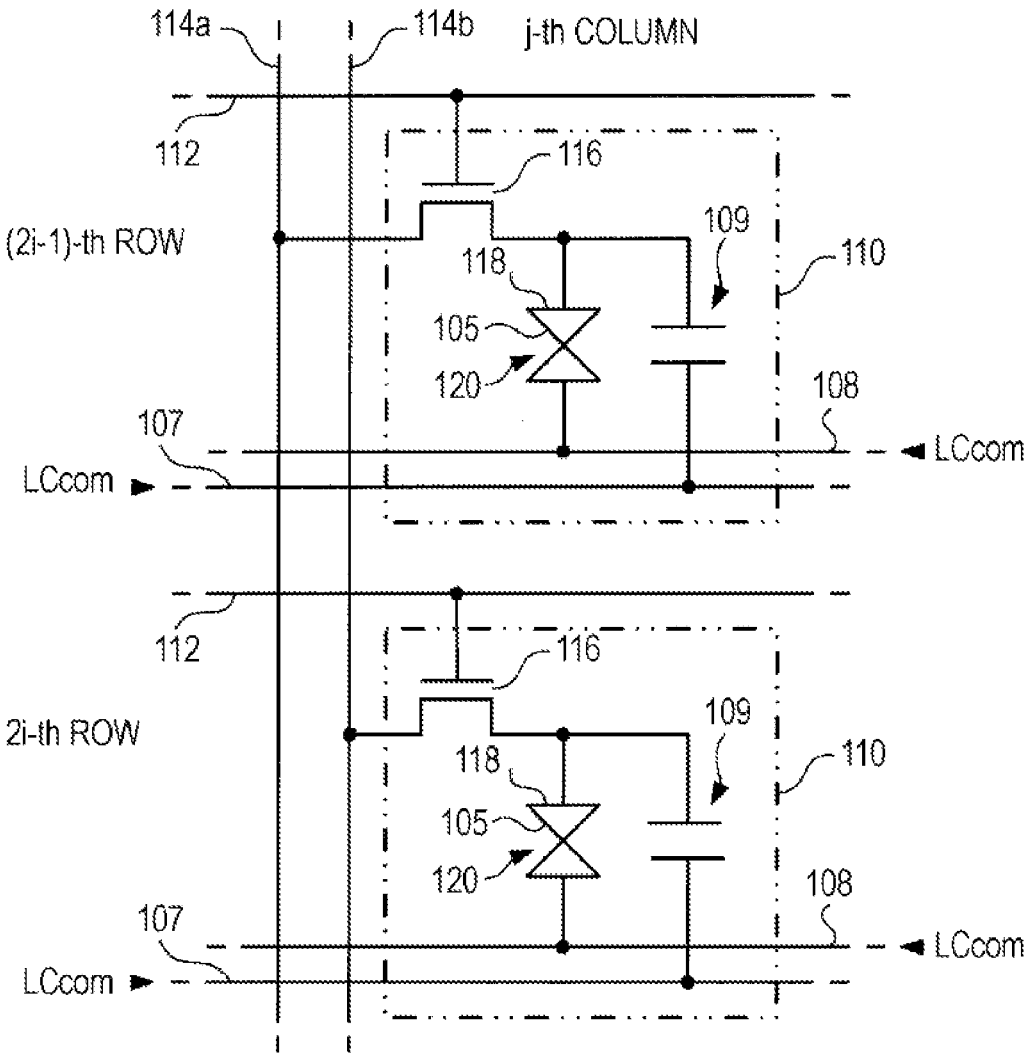
FIG. 3 is a view illustrating a configuration of pixels in the display panel.

FIG. 3 is a view illustrating the pixel 110 (that is, the pixel (2i−1, j)) in the (2i−1)-th row and j-th column and the pixel 110 (that is, the pixel (2i, j)) in the 2i-th row and j-th column that is positioned one row below the (2i−1)-th row and j-th column and thus is adjacent to the (2i−1)-th row and j-th column. At this point, the i is an arbitrary integer ranging from 1 to m/2 and the j is an arbitrary integer ranging from 1 to n. That is, the pixel 110 in the (2i−1)-th row and j-th column is a pixel in the odd-numbered row, and the pixel 110 in the 2i-th row and j-th column is a pixel in the even-numbered row. As illustrated in FIG. 3, each pixel 110 includes an N-channel type thin film transistor (hereinafter referred to as a pixel transistor) 116 and a liquid crystal capacity 120. While a gate electrode of the pixel transistor 116 is connected to the scan line 112 in the (2i−1)-th row, in the pixels 110 in the (2i−1)-th row and j-th column, a source electrode of the pixel transistor 116 is connected to an odd-numbered row data line 114*a* in the j-th column and a drain electrode of the pixel transistor 116 is connected to a pixel electrode 118 that is one terminal of the liquid crystal capacity 120. Furthermore, the other terminal of the liquid crystal capacity 120 is connected to the common electrode 108. A common voltage LCcom from the LCcom adjustment circuit 70 is applied to the common electrode 108, over all the pixels 110. While the gate electrode of the pixel transistor 116 is connected to the scan line 112 in the 2i-th row, in the pixels 110 in the 2i-th row and j-th column, and the source electrode of the pixel transistor 116 is connected to the even-numbered row data line 114*b* in the j-th column, and the drain electrode of the pixel transistor 116 is connected to a pixel electrode 118 that is one terminal of the liquid crystal capacity 120.

The display panel 100 is not specifically illustrated, but has a configuration that includes a pair of an element substrate and an opposing substrate which are attached to each other with a given gap in between and that seals liquid crystal 105 in the given gap. In these substrates, the scan line 112, the data line 114, the pixel transistor 116, and the pixel electrode 118 are formed on the element substrate, along with the scan line drive circuit 130, the first data line drive circuit 140 and the second data line drive circuit 150, and on the other hand, the common electrode 108 is formed on the opposing substrate and these electrode-formed surfaces are attached to each other with the given gap in between, in such a manner as to face each other. Because of this, in the present embodiment, the liquid crystal capacity 120 is configured by the pixel electrode 118 and the common electrode 108 are caused to interpose the liquid crystal 105.

Moreover, in the element substrate, the odd-numbered row data line 114*a* and the even-numbered row data line 114*b* are provided on different wire layers that are separated from each other with an insulation film in between, respectively. Accordingly, the wiring of the odd-numbered row data line 114*a* and the even-numbered row data line 114*b* is easily performed. Furthermore, the odd-numbered row data line 114*a* and the even-numbered row data line 114*b* may be arranged in such a manner as to at least partly overlap each other when viewed from the direction perpendicular to a display surface of the display panel 100. Accordingly, the area necessary to install the data line 114 (114*a* and 114*b*) is reduced and a pixel aperture ratio (the proportion of the area of the pixel electrode to the area of the whole display panel) is improved in the display panel 100.

In the present embodiment, it is assumed that the display panel 100 is used in the liquid crystal display using a backlight, and the display panel 100 is set to a normally black mode. In the normally black mode, a black display is performed where the transmissivity of light penetrating the liquid crystal capacity 120 is at a minimum when a voltage applied to the liquid crystal capacity 120 is zero, and a white display is performed where as the voltage applied to the liquid crystal capacity 120 is increased, the amount of light penetrating the liquid crystal capacity 120 is increased and finally the transmissivity is at a maximum.

In this configuration, when a selection voltage is applied to a certain scan line 112 (that is, the scan line 112 is selected) and the pixel transistor 116 connected to this scan line 112 turns on (conducts), a signal (a voltage) on the corresponding data line 114 (114*a* or 114*b*) is written into the pixel electrode 118 corresponding to each pixel transistor 116 (the writing of the signal into the pixel electrode 118 is referred to as the writing of the signal into the pixel 110). Furthermore, as described below, the voltage on the data line 114 is supplied with respect to each pixel 110 connected to the selected scan line 112. Therefore, the light that penetrates the liquid crystal capacity 120 may be different for each pixel 110. By sequentially selecting the scan lines 112 (vertical scanning) and modulating the light that penetrates the liquid crystal capacity 120 of each pixel 110, the image is formed in the display area Ma. In addition, the formed image is seen square on by a user, or is enlarged and projected to be visually recognized, as in a projector described below.

In addition, when the voltage applied to the scan line 112 becomes a non-selection voltage, the pixel transistor 116 connected to the scan line 112 is in an OFF state (non-conduction), but because OFF resistance at this time ideally does not become infinite, the electric charge accumulated in the liquid crystal capacity 120 leaks in no small amount. In order to lessen the influence by this off-leak, a storage capacity 109 is formed for each pixel 110. While one terminal of this storage capacity 109 is connected to the pixel electrode 118 (the drain of the pixel transistor 116), the other terminal is commonly connected to a capacity line 107 over all the pixels 110. For example, the same voltage LCcom as supplied to the common electrode 108 is supplied to this capacity line 107.

Again referring to FIG. 2, the scan line drive circuit 130 supplies scanning signals Y1, Y2, Y3 and so forth to Ym to the first, second, third and so forth to M-th row scan lines 112, respectively, based on the start pulse Dy and the clock signal Cly that are supplied from the control circuit 10. At this point, the scan line drive circuit 130 causes the scan signal to the selected scan line 112 to be at an H level equivalent to the selection voltage Vdd, and causes the scan signal to the other scan line 112 to be at an L level equivalent to the non-selection voltage (for example, ground potential Gnd).

The first data line drive circuit 140 samples the odd-numbered row voltage signal Vid1 as data signals X1*a*, X2*a*, X3*a* and so forth to Xna that are output to the odd-numbered row data line 114*a* in the first, second, third, and so forth to n-th columns, respectively, based on the start pulse Dx and the clock signal Clx that are supplied from the control circuit 10. Likewise, the second data line drive circuit 150 samples the even-numbered row voltage signal Vid2 as data signals X1*b*, X2*b*, X3*b* and so forth to Xnb that are output to the even-numbered row data line 114*b* in the first, second, third, and so forth to n-th columns, respectively, based on the start pulse Dx and the clock signal Clx that are supplied from the control circuit 10.

Figure 4:
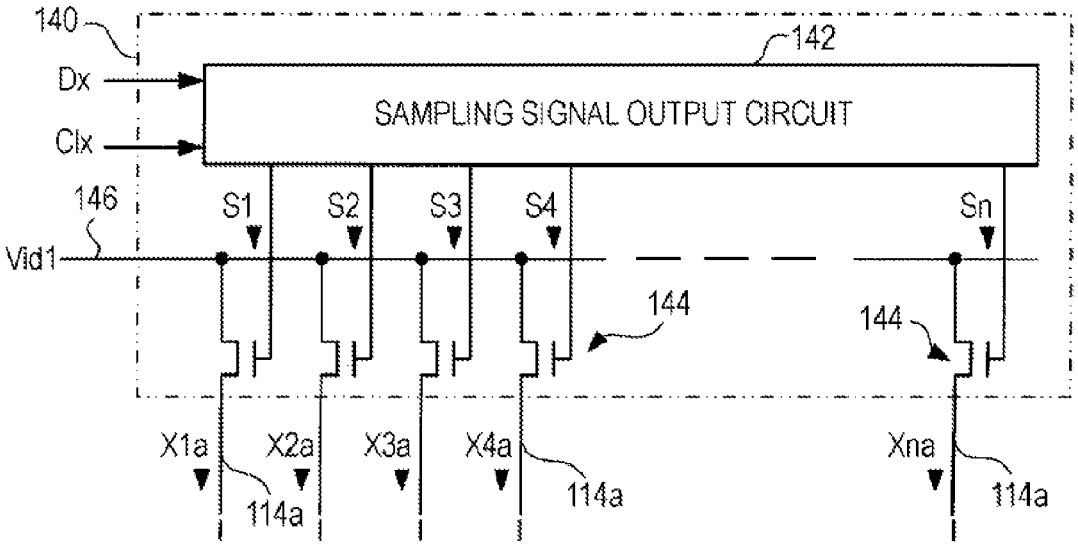
FIG. 4 is a view illustrating a configuration of a first data line drive circuit.

FIG. 4 is a view illustrating a configuration of the first data line drive circuit 140. As illustrated in FIG. 4, the first data line drive circuit 140 has a sampling signal output circuit 142 and an N-channel type transistor 144 (hereinafter referred to as a selection transistor 144) that is provided on each data line 114*a*. Furthermore, the odd-numbered row voltage signal Vid1 that is converted by the first D/A conversion circuit 50 is supplied to a signal line 146. In the selection transistor 144 provided in each column, the source electrode is connected to the signal line 146, and the drain electrode is connected to the corresponding odd-numbered row data line 114*a*. The sampling signal output circuit 142 outputs sampling signals S1, S2, S3, and so forth to Sn that correspond to each column in such a manner as to be exclusively at the H level and supplies the result to the gate electrode of the selection transistor 144 in the corresponding column, based on the start pulse Dx and the clock signal Clx that are supplied from the control circuit 10. Therefore, when the sampling signal in a certain column becomes at the H level, the selection transistor 144 in the corresponding columns turns on, the odd-numbered row voltage signal Vid1 supplied to the signal line 146 is sampled, and is outputted to the data line 114*a* in the corresponding column. When the sampling signal reach the L level and the selection transistor 144 turns off, the voltage on corresponding data line 114*a* is decreased somewhat due to leakage current, but is generally maintained with the same value. Moreover, since the configuration of the second data line drive circuit 150 is the same as the first data line drive circuit 140, except that the voltage signal inputted is an even-numbered row voltage signal Vid2, and the data line to which the sampled data signal is outputted is an even-numbered row data line 114*b*, the illustration is omitted.

As described above, in the present embodiment, the image data Db read out from the memory 20 is divided into the odd-numbered row image data Db1 and the even-numbered row image data Db2 by the separation circuit 30. The odd-numbered row image data Db1, after converted to the voltage signal Vid1 in the first D/A conversion circuit 50, is sampled by the first data line drive circuit 140, and is supplied to the odd-numbered row data line 114*a*, and the even-numbered row image data Db2, after converted to the voltage signal Vid2 in the second D/A conversion circuit 60, is sampled by the second data line drive circuit 150, and is supplied to the even-numbered row data line 114*b*. That is, a signal (voltage) is separately supplied to the odd-numbered row data line 114*a*, and the even-numbered row data line 114*b*. Therefore, for example, by causing the scan signal of the scan line 112 in the odd-numbered row and the scan signal of the scan line 112 in the even-numbered row to be at the H level simultaneously in such a manner as to cause the scan signals Y1 and Y2 to be at the H level simultaneously and cause the scan signals Y3 and Y4 to be at the H level simultaneously, the scan line 112 in the odd-numbered row and the scan line 112 in the even-numbered row may be selected simultaneously and the writing of the data (the voltage) into the pixels 110 connected to each of the scan lines 112 (the horizontal scanning) may be performed simultaneously. A data writing speed is increased by simultaneously selecting the scan line 112 in the odd-numbered row and the scan line 112 in the even-numbered row and performing the data writing, in this manner.

Subsequently, operation of the compensation circuit 40 is described. To facilitate understanding of the operation of the compensation circuit 40, operation of the first D/A conversion circuit 50 without the compensation circuit 40 (or in a case where compensation is not performed on the odd-numbered row image data Db1 by the compensation circuit 40) is first described.

Figure 5:
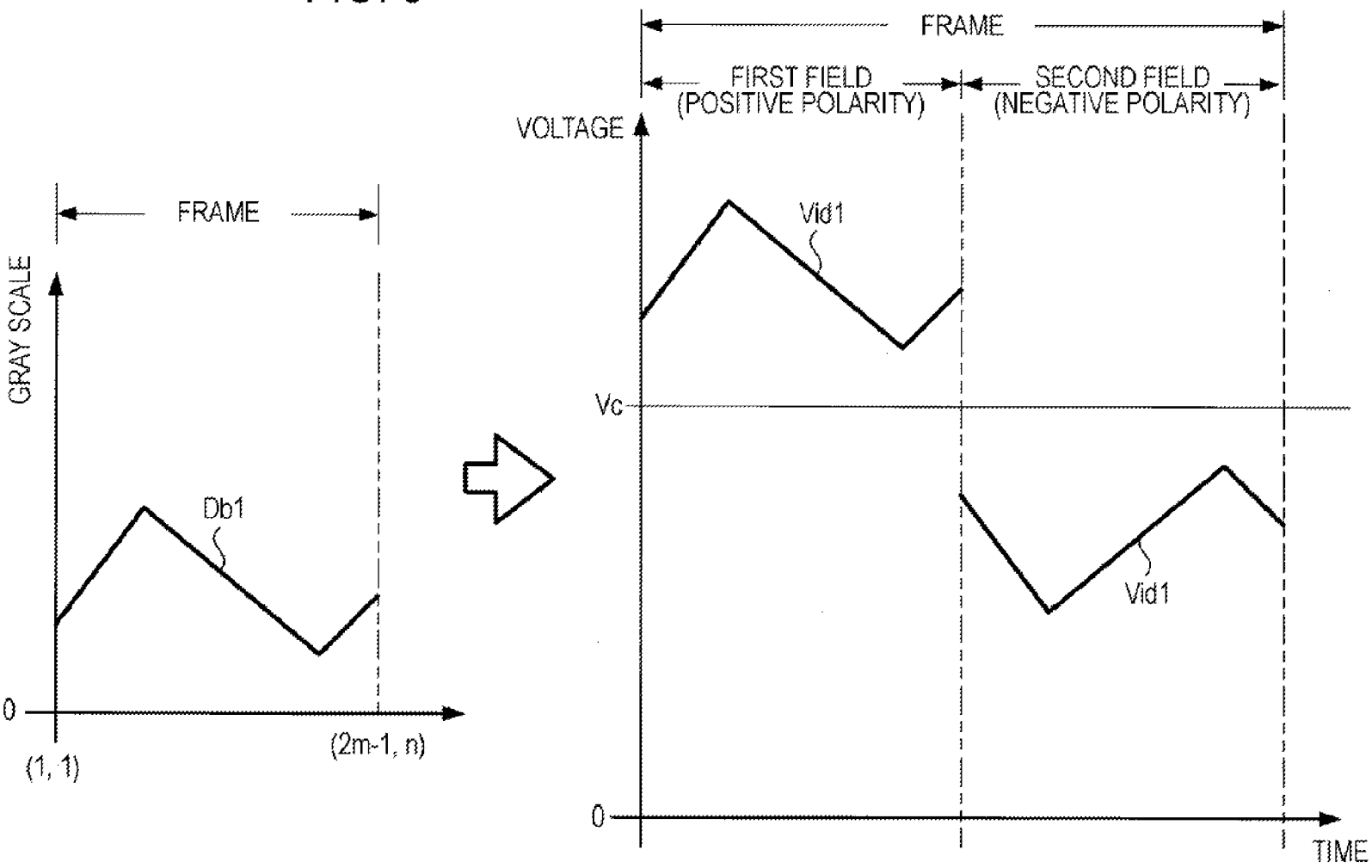
FIG. 5 is a view illustrating operation of a first D/A conversion circuit.

FIG. 5 is a view to describe the operation of the first D/A conversion circuit 50. The graph on the left-hand side of FIG. 5 illustrates one frame of the odd-numbered row image data Db1 outputted from the separation circuit 30. As illustrated in FIG. 5, the odd-numbered row image data Db1 determines the grayscale level with respect to each of the pixels 110 (the pixel (1, 1), the pixel (1, 2), and so forth to the pixel (2m−1, n)) in each of the odd-numbered rows.

The graph on the right-hand side of FIG. 5 illustrates the odd-numbered row voltage signal Vid1 obtained by causing the first D/A conversion circuit 50 to perform a D/A conversion on the odd-numbered row image data Db1. When given a positive polarity writing instruction by the polarity designation signal Pol, the first D/A conversion circuit 50 converts the odd-numbered row image data Db1 to a high-level voltage on the basis of a voltage Vc that is determined in advance with respect to a reference potential (for example, the ground potential GND). When given a negative polarity writing instruction by the polarity designation signal Pol, the first D/A conversion circuit 50 converts the same image data Db1 to a low-level voltage on the basis of the voltage Vc and supplies the converted voltage to the display panel 100, as the odd-numbered row voltage signal Vid1. That is, in the present embodiment, the level that is higher than the voltage Vc is defined as the positive polarity and the level that is lower than the voltage Vc is defined as the negative polarity (the voltage Vc is hereinafter referred to as the polarity reference voltage), in terms of the polarity of the voltage signal Vid1. In the present embodiment, the polarity designation signal Pol designates the positive polarity writing in the first half of each frame (the first field), and designates the negative polarity writing in the second half of each frame (the second field). As a result, as illustrated on the graph on the right-hand side of FIG. 5, the first D/A conversion circuit 50 converts the image data Db1 to the high-level voltage on the basis of the polarity reference voltage Vc, in the first field, and converts the image data Db1 to the low-level voltage on the basis of the polarity reference voltage Vc, in the second field. Accordingly, in the first field, a voltage higher than the polarity reference voltage Vc is written into the pixel electrode 118 of the pixel 110 (the positive polarity writing), and in the second field, the voltage lower than the polarity reference voltage Vc is written into the pixel electrode 118 of the pixel 110 (the negative polarity writing). That is, in the present embodiment, an aspect inversion method is employed which causes the polarity voltages written into all the pixels 110 over the field to be of the same polarity and reverses the polarity in each field. Moreover, the polarity reference voltage Vc agrees with the center of an amplitude of the odd-numbered row voltage signal Vid1 that is output from the first D/A conversion circuit 50 in a case where the compensation circuit 40 is not present.

The operation of the second D/A conversion circuit 60 is the same as the operation of the first D/A conversion circuit 50, and converts the even-numbered row image data Db2 to the high-level voltage or the low-level voltage on the basis of the polarity reference voltage Vc according to the polarity designation signal Pol, and supplies the converted voltage to the display panel 100, as the even-numbered row voltage signal Vid2.

Ideally, the voltages (Vid1 and Vid2) that convert the same image data (Db1 and Db2) to the high-level and the low-level, respectively, in the first field and the second field, on the basis of the polarity reference voltage Vc are written into the pixel electrode 118 of the pixel 110. In such a case, the direct current component of the voltage applied to the liquid crystal 105 may be made zero by causing the voltage LCcom of the common electrode 108 to match the voltage Vc. However, in practice, the voltage written into the pixel electrode 118 does not match the voltages Vid1 and Vid2 that are outputted from the first and second D/A conversion circuits 50 and 60, and thus a deviation occurs.

Figure 6:
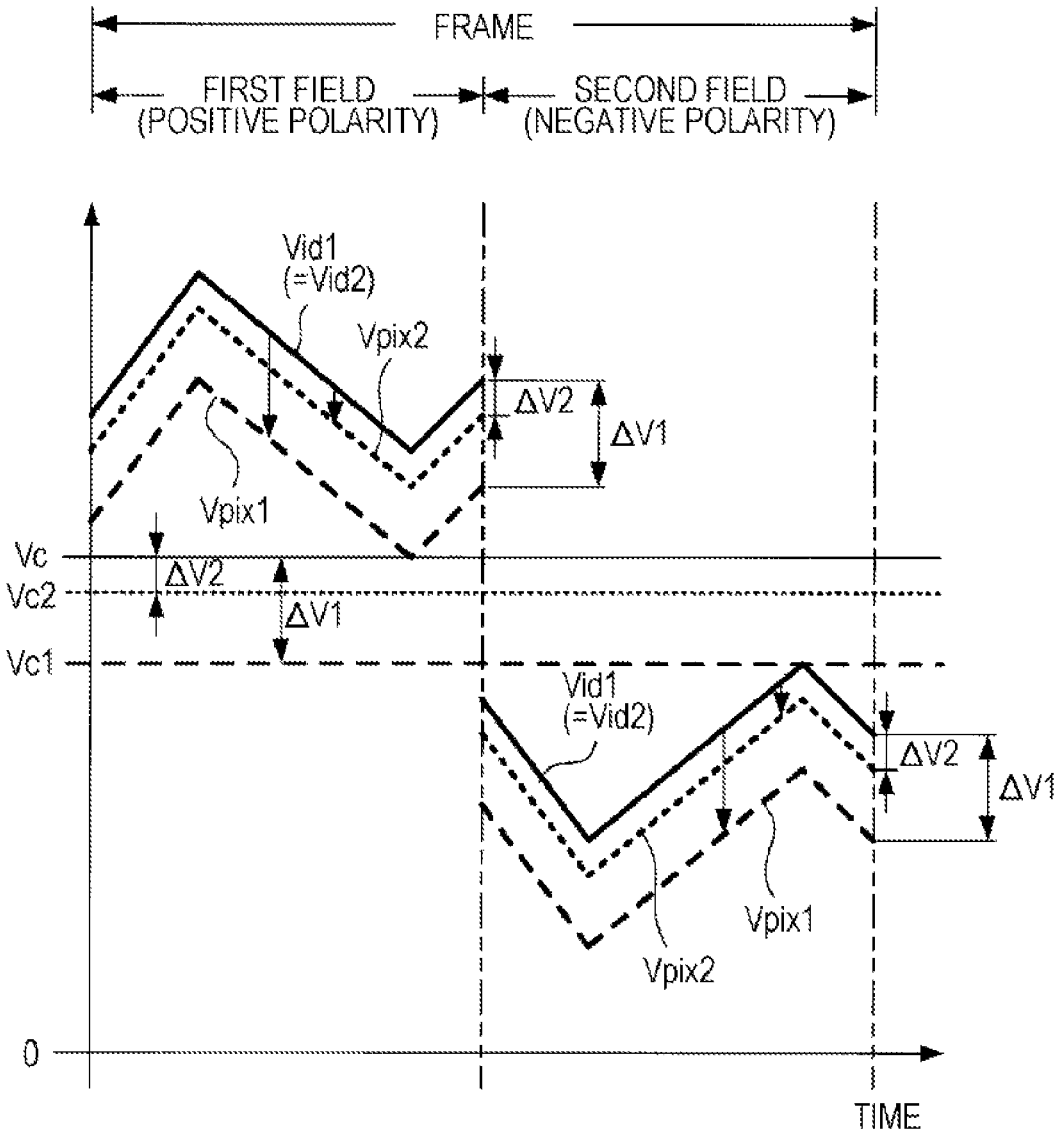
FIG. 6 is a view illustrating a voltage that is written into a pixel electrode in a case where a compensation circuit is not present.

FIG. 6 is a view to describe the voltage that is written into the pixel electrode 118 of the pixel 110, in a case where the compensation circuit 40 is not present. At this point, for the sake of brevity of description, the odd-numbered row image data Db1 and the even-numbered row image data Db2 are defined as being the same. Furthermore, the voltage signal Vid1 that causes the first D/A conversion circuit 50 to convert the image data, and the voltage signal Vid2 that causes the second D/A conversion circuit 60 to convert the image data are defined as the same, and are indicated as a solid line in FIG. 6.

As indicates as a dashed line in FIG. 6, the voltage (hereinafter referred to as the pixel voltage) Vpix1 written into the pixel electrode 118 of the pixels 110 in the odd-numbered row is decreased only by a difference ΔV1 from the voltage signal Vid1 output from the first D/A conversion circuit 50 in any one of the first field (the positive polarity writing) and the second field (the negative polarity writing). This mainly results from the phenomenon called "feed-through" in which the voltage of the pixel electrode 118 connected to the drain electrode is changed from the voltage supplied to the data line 114*a*, under the influence of a parasitic capacity between the gate and drain electrodes of the pixel transistor 116, when the pixel transistor 116 corresponding to each pixel 110 is changed from in an ON state to in an OFF state. In the present example, since the pixel transistor 116 is an N-channel type, the voltage change direction due to field-through is a downward direction in any one of the positive polarity writing and the negative polarity writing. Furthermore, feed-through occurs with respect to the voltage on the data line 114*a* as well. That is, the voltage of the data line 114*a* connected to the drain electrode is changed from the voltage (that is, the voltage signal Vid1) supplied to the signal line 146, under the influence of the parasitic capacity between the gate and drain electrodes of the selection transistor 144, when the selection transistor 144 is changed from being in an ON state to an OFF state. In the present example, since the selection transistor 144 is an N-channel type, the voltage change direction due to the feed-through of the selection transistor 144 is a downward direction as well. The deviation resulting from the voltage signal Vid1 of the pixel voltage Vpix1 that arises from, for example, feed-through is hereinafter referred to as a voltage displacement ΔV1. In this manner, the pixel voltage Vpix1 written into the pixels 110 in the odd-numbered row is decreased only by the voltage displacement ΔV1 from the voltage signal Vid1 that is output from the first D/A conversion circuit 50, in any one of the first field and the second field, and as a result, a central voltage Vc1 of the amplitude of the pixel voltage Vpix1 in the odd-numbered row becomes a voltage that is a result of being decreased only by the voltage displacement ΔV1 from the polarity reference voltage Vc.

Similarly, as indicated as a dotted line in FIG. 6, a pixel voltage Vpix2 written into the pixel electrode 118 of the pixels 110 in the even-numbered row is decreased only by the voltage displacement ΔV2 from the voltage signal Vid2 that is outputted from the second D/A conversion circuit 60 as well, in any one of the first field and the second field, with the influence of, for example, the feed-through of the pixel transistor 116 and the selection transistor 144, and a central voltage Vc2 of the amplitude of the pixel voltage Vpix2 in the even-numbered row becomes a voltage that is a result of being decreased only by the voltage displacement ΔV2 from the polarity reference voltage Vc, but the voltage displacement ΔV2 in the even-numbered row are different from the voltage displacement ΔV1 in the odd-numbered row. This is considered to originate from the result that, for example, since the data line 114*a* for the pixels 110 in the odd-numbered row and the data line 114*b* for the pixels 110 in the even-numbered row are provided on the different wire layers, the capacity formed between the data lines 114*a* and 114*b* and the neighboring component changes in size and the voltage reductions due to the feed-through of the selection transistor 144 are different in size. Furthermore, since the data line drive circuit of the display panel 100 is divided into the first data line drive circuit 140 driving the data line 114*a* connected to the pixels 110 in the odd-numbered row and the second data line drive circuit 150 driving the data line 114*b* connected to the pixels 110 in the even-numbered row, a difference in size may also take place between the voltage displacement ΔV1 in the even-numbered row and the voltage displacement ΔV2 in the even-numbered row. Moreover, the voltage displacement ΔV1 of the pixels 110 in the odd-numbered row is expressed as greater than the voltage displacement ΔV2 of the pixels 110 in the even-numbered row (ΔV1>ΔV2) in the present example, but this is just an example and therefore, ΔV1<ΔV2 may be the case.

In a case where the voltage displacement ΔV1 of the pixels 110 in the odd-numbered row and the voltage displacement ΔV2 of the pixels 110 in the even-numbered row are different from each other in this manner, the pixels 110 in the odd-numbered row and the pixels 110 in the even-numbered row are different in the optimal voltage LCcom of the common electrode 108 from each other. That is, it is desirable that the voltage LCcom of the common electrode 108 is caused to match an amplitude center Vc1 (=Vc−ΔV1) of the pixel voltage Vpix1 in the odd-numbered row in order to reduce the direct current component applied to the liquid crystal 105 with respect to the pixels 110 in the odd-numbered row, but it is desirable that the voltage LCcom of the common electrode 108 is caused to match an amplitude center Vc2 (=Vc−ΔV2) of the pixel voltage Vpix2 in the even-numbered row in order to reduce the direct current component applied to the liquid crystal 105 with respect to the pixels 110 in the even-numbered row. Therefore, when the voltage LCcom of the common electrode 108 is set to match the amplitude center Vc2 of the pixel voltage Vpix2 in the even-numbered row, in such a manner as to offset the voltage displacement ΔV2 of the pixels 110 in the even-numbered row (LCcom=Vc−ΔV2), a direct current voltage component may act on the liquid crystal in the pixels 110 in the even-numbered row and thus the flicker and the screen burn may occur.

Figure 7:
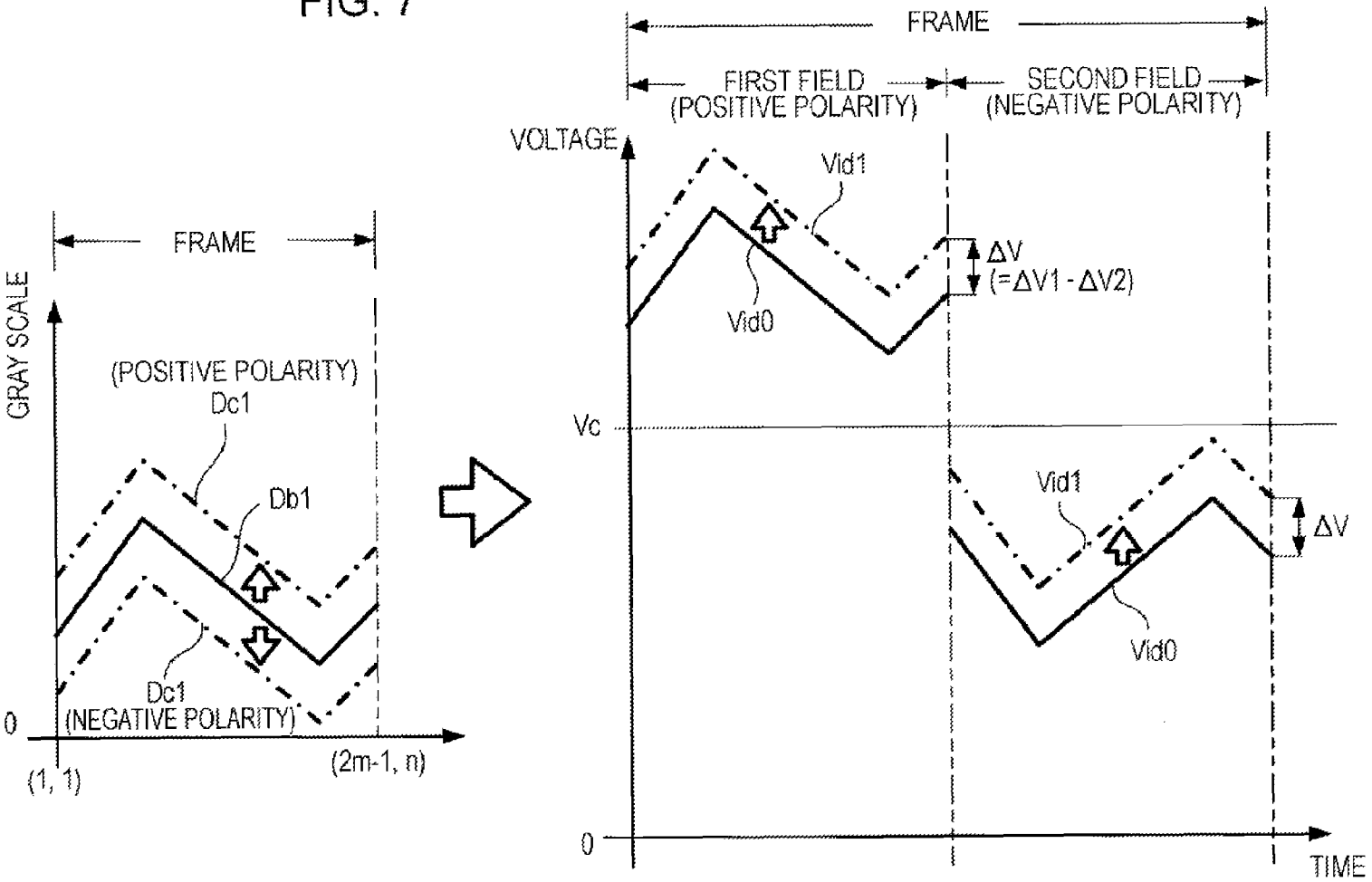
FIG. 7 is a view illustrating operation of the compensation circuit.

FIG. 7 is a view to describe operation of the compensation circuit 40. At this point, the operation of the compensation circuit 40 is described which is applied in a case where the voltage LCcom of the common electrode 108 is set to LCcom=Vc−ΔV2 in such a manner as to offset the voltage displacement ΔV2 of the pixels 110 in the even-numbered row, with respect to the display panel 100 that has the voltage displacement ΔV1 of the pixels 110 in the odd-numbered row and the voltage displacement ΔV2 of the pixels 110 in the even-numbered row, as illustrated in FIG. 6 (that is, ΔVsh=ΔV2 when the deviation of the voltage LCcom of the common electrode 108 from the polarity reference voltage Vc is defined as ΔVsh). Furthermore, the voltage signal obtained in a case where the odd-numbered row image data Db1 is converted in the first D/A conversion circuit 50 without receiving compensation in the compensation circuit 40 is indicated as a voltage signal Vid0 in FIG. 7.

As indicated as a dashed dotted line on the graph on the left-hand side of FIG. 7, the compensation circuit 40 performs compensation to shift the odd-numbered row image data Db1 that is output from the separation circuit 30 in the direction of increasing the grayscale level at the time of the positive polarity writing (the first field) and performs compensation to shift the odd-numbered row image data Db1 that is output from the separation circuit 30 in the direction of decreasing the grayscale level at the time of the negative polarity writing (the second field), and supplies the image data Dc1, on which compensation is performed, to the first D/A conversion circuit 50. As a result, as indicated as a dashed dotted line on the graph on the right-hand side of FIG. 7, the voltage signal Vid1 that is output from the first D/A conversion circuit 50 is in the waveform where the voltage signal Vid0 obtained by performing the D/A conversion on the image data Db1 without performing compensation in the compensation circuit 40 is shifted only by a value ΔV in the direction of going away from the polarity reference voltage Vc in the first field (the positive polarity writing) and the voltage signal Vid0 obtained by converting the image data Db1 without performing compensation in the compensation circuit 40 is shifted only by a value ΔV in the direction of approaching the polarity reference voltage Vc in the second field (the negative polarity writing). In other words, the voltage signal Vid1 obtained by performing the D/A conversion on the image data Dc1, on which compensation is performed by the compensation circuit 40 has a waveform where the voltage signal Vid0 obtained by performing the D/A conversion on the image data Db1 without performing compensation by the compensation circuit 40 is shifted in such a manner as to increase only by the value ΔV in any one of the first field and the second field. At this point, the amount of the voltage increase ΔV (the amount of the voltage shift) in the voltage signal Vid1 with respect to the voltage signal Vid0 is preferably equal to the difference (ΔV1−ΔV2) between the voltage displacement ΔV1 of the pixels 110 in the odd-numbered row and the voltage displacement ΔV2 of the pixels 110 in the even-numbered row. Therefore, the amount of the shift in the image data Dc1 with respect to the image data Db1 in the compensation circuit 40 is adjusted in such a manner as to be ΔV=ΔV1−ΔV2.

Figure 8:
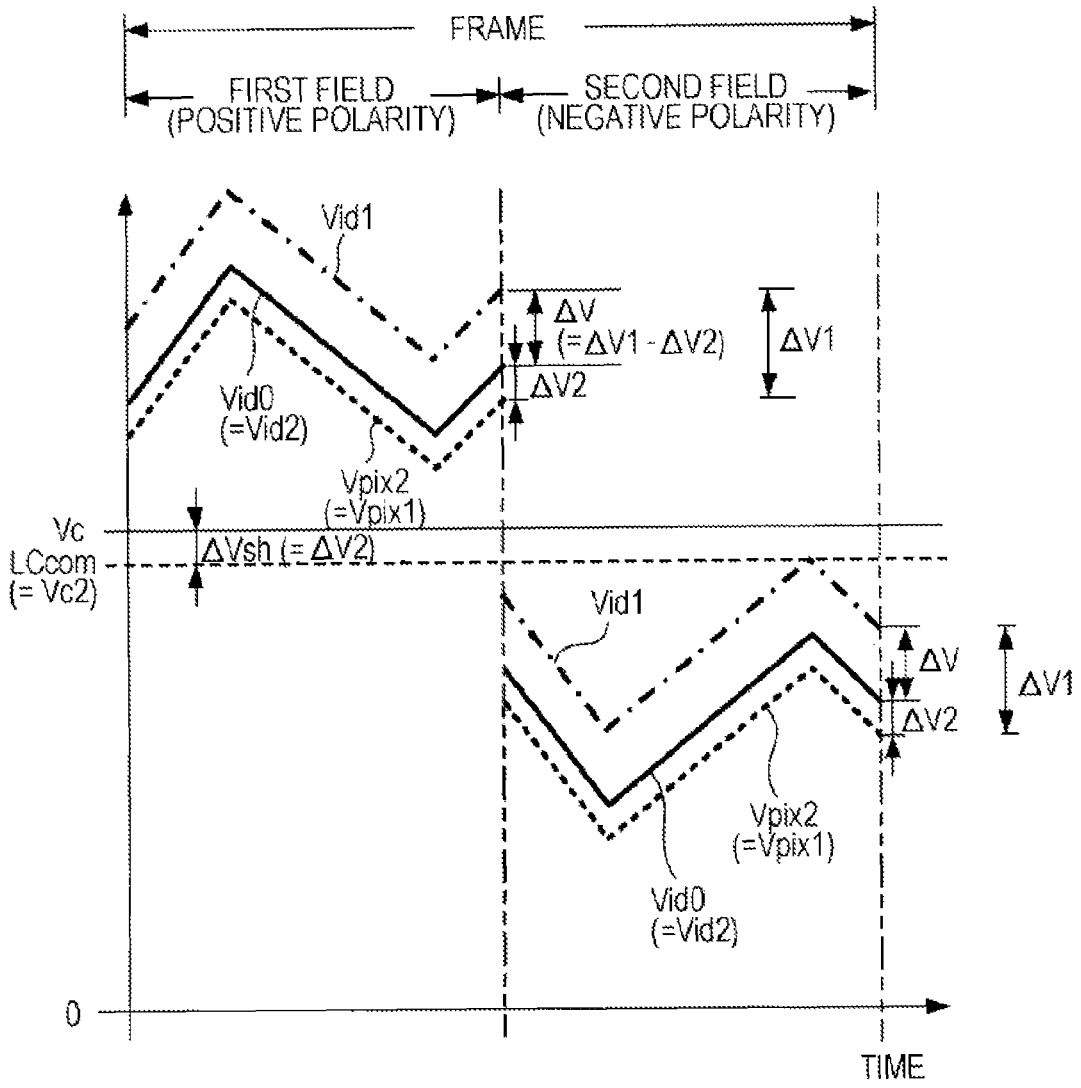
FIG. 8 is a view illustrating a voltage of each component of the electro-optical device in a case of performing compensation in the compensation circuit.

FIG. 8 is a view to describe a voltage of each component of the electro-optical device 1 in the case of performing compensation in the compensation circuit 40 as illustrated FIG. 7. In FIG. 8 for the sake of brevity of description, the odd-numbered row image data Db1 and the even-numbered row image data Db2 are defined as equal to each other in the same manner as in FIG. 6. Therefore, the voltage signal Vid0 obtained by the D/A conversion on the odd-numbered row image data Db1, on which compensation is not performed by the compensation circuit 40 being performed in the first D/A conversion circuit 50 is equal to the voltage signal Vid2 obtained by the D/A conversion on the even-numbered row image data Db2 being performed in the second D/A conversion circuit 60.

As described referring to FIG. 6, the pixel voltage Vpix2 (indicated as a dotted line in FIG. 8) written into the pixel electrode 118 of the pixels 110 in the even-numbered row is decreased only by the voltage displacement ΔV2 from the voltage signal Vid2 that is output from the second D/A conversion circuit 60, in any one of the first field and the second field, and a central voltage Vc2 of the amplitude of the pixel voltage Vpix2 in the even-numbered row becomes a voltage that is a result of being decreased only by the voltage displacement ΔV2 from the polarity reference voltage Vc that is the amplitude center of the voltage signal Vid2. The voltage LCcom of the common electrode 108 is set in such a manner as to match the amplitude center Vc2 of the pixel voltage Vpix2 in the even-numbered row.

Furthermore, as described referring to FIG. 7, since the odd-numbered row image data Db1 receives compensation in the compensation circuit 40, in such a manner that the grayscale level increases in the first field and the grayscale level decreases in the second field and the image data Dc1, on which compensation is performed, is supplied to the first D/A conversion circuit 50, the voltage signal Vid1 (indicated as a dashed dotted line in FIG. 8) that is output from the first D/A conversion circuit 50 is in the waveform where the voltage signal Vid0 obtained by performing the D/A conversion on the image data Db1 without performing compensation in the compensation circuit 40 is increased only by ΔV=ΔV1−ΔV2 in any one of the first field and the second field. Because of this, the pixel voltage Vpix1 in the even-numbered row that is decreased by the voltage displacement ΔV1 from the voltage signal Vid1 due to the influence by, for example, the feed-through agrees with the pixel voltage Vpix2 in the even-numbered row. That is, the amplitude center Vc1 of the pixel voltage Vpix1 in the even-numbered row and the amplitude center Vc2 of the pixel voltage Vpix in the even-numbered row match each other. As described above, the voltage LCcom of the common electrode 108 is set in such a manner as to match the amplitude center Vc2 of the pixel voltage Vpix2 in the even-numbered row. Therefore, in the present embodiment, since the amplitude centers Vc1 and Vc2 of the pixel voltages Vpix1 and Vpix2 match the voltage LCcom of the common electrode 108, the direct current voltage component does not act on the liquid crystal 105 in any one of the pixels 110 in the odd-numbered row and the pixels 110 in the even-numbered row.

Moreover, an amount of voltage shift ΔV that the voltage signal Vid1 output from the first D/A conversion circuit 50 shifts with respect to the voltage signal Vid0 output from the first D/A conversion circuit 50, in a case where compensation is not performed on the image data by the compensation circuit 40, may not necessarily match the difference (ΔV1−ΔV2) between the voltage displacement ΔV1 in the odd-numbered row and the voltage displacement ΔV2 in the even-numbered row. The amount of voltage shift ΔV may be set in such a manner as to make the difference small between the amplitude center Vc1 of the pixel voltage Vpix1 in the odd-numbered row and the amplitude center Vc2 of the pixel voltage Vpix2 in the even-numbered row (that is, to make the difference small between the optimal voltage LCcom of the common electrode 108 with respect to the pixels 110 in the odd-numbered row and the optimal voltage LCcom of the common electrode 108 with respect to the pixels 110 in the even-numbered row). Accordingly, when the voltage LCcom of the common electrode 108 is set according to one of the pixel 110 in the odd-numbered row and the pixel 110 in the even-numbered row, flickering and screen burn are reduced in the other of the pixel 110 in the odd-numbered row and the pixel 110 in the even row.

Electronic Apparatus

Figure 9:
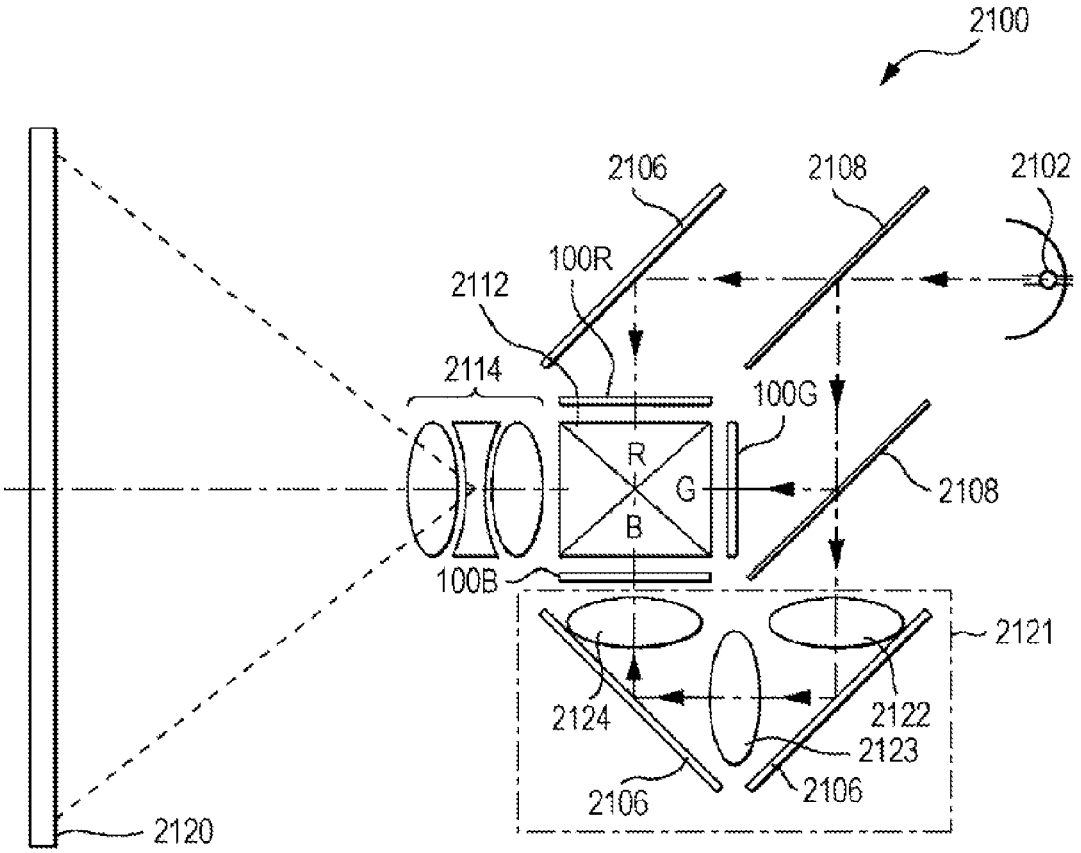
FIG. 9 is a view illustrating a configuration of a projector to which the electro-optical device is applied.

Next, one example of an electronic apparatus, to which the electro-optical device 1 according to the embodiment described above is applied, is described taking a projector as an example. FIG. 9 is a plan view illustrating a configuration of the projector. As illustrated in FIG. 9, a lamp unit 2102 that is made from a white light source such as a halogen lamp is provided inside a projector 2100. Emitted light emitted from the lamp unit 2102 is separated into three primary colors of R (red), G (green), and B (blue) by three mirrors 2106 and two dichroic mirrors 2108 which are arranged inside and is led to light valves 100R, 100G, and 100B corresponding to the primary colors, respectively. In addition, the light of B color is led via a relay lens system 2121 which is made from an incidence lens 2122, a relay lens 2123, and an emitted light lens 2124, in order to prevent the loss of the light of B color, because the light of B color has a long optical path when compared with the other colors R and G.

In the projector 2100, 3 sets of the electro-optical device 1 according to the embodiment are provided to correspond to the R color, the G color, and the B color, respectively. Then, the projector 2100 is configured so that items of the image data corresponding to the R color, the G color, and the B color, respectively, are supplied from their respective high-level circuits and are converted to the data signals Vid1 and Vid2 corresponding to each color. The light valves 100R, 100G, and 100B have the same configuration as that of the display panel 100 described above and are driven according to the items of image data corresponding to the respective colors R, G, and B.

The light modulated by the light valves 100R, 100G, and 100B, respectively, is incident on the dichroic prism 2112 from three directions. Then, while the light of R color and the light of B color are refracted at 90 degrees, the light of G color goes straight on, in the dichroic prism 2112. Therefore, after the images are synthesized, a color image is projected on a screen 2120 by a projection lens 2114.

It is not necessary to provide a color filter, because the light corresponding to each of the R color, the G color, and the B color is incident on the light valves 100R, 100G, and 100B due to the dichroic mirror 2108. The projector 2100 has a configuration in which the direction of the horizontal scanning by the light valves 100R and 100B is opposite to the direction of the horizontal scanning by the light valves 100G and the image of which the left side, and the right are reversed with respect to each other is displayed, because a penetration image of the light valve 100G is projected as it is done while penetration image of the light valves 100R and 100B is projected after being reflected by the dichroic prism 2112.

Furthermore, in addition to the projector described above referring to FIG. 9, an electronic viewfinder, a rear-projection-type television, a head mount display and the like are enumerated as the electronic equipment.

Other Embodiment

The invention is not limited to the embodiment described above, and various modifications may be made to the embodiment. Modification examples are described below. Moreover, two or more of the embodiments described above and the modification examples described above may be combined and used.

MODIFICATION EXAMPLE 1

In the embodiment described above, the electro-optical device 1 has the compensation circuit 40 that performs compensation on the grayscale level of the odd-numbered row image data Db1, but the invention is not limited to this configuration. The electro-optical device 1 may have a compensation circuit that performs compensation on the grayscale level of the even-numbered row image data Db2, instead of the compensation circuit 40 that performs compensation on the grayscale level of the odd-numbered row image data Db1. In such a case, the voltage LCcom of the common electrode 108 may be set in such a manner as to match the amplitude center Vc1 (=Vc−ΔV1) of the pixel voltage Vpix1 in the odd-numbered row. Otherwise, the electro-optical device 1 may have the compensation circuit that performs compensation on the grayscale level of the even-numbered row image data Db2, in addition to the compensation circuit 40 that performs compensation on the grayscale level of the odd-numbered row image data Db1.

Figure 10:
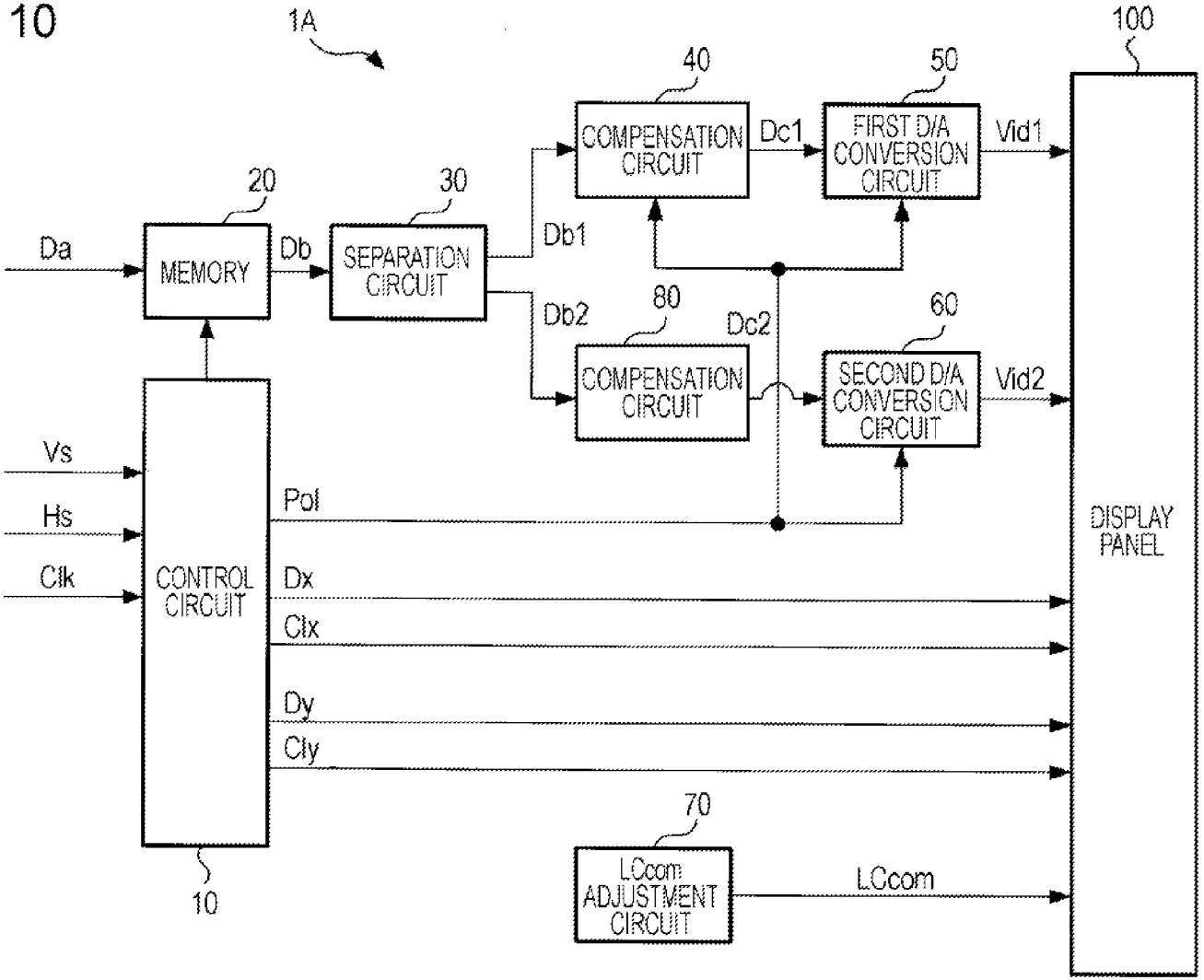
FIG. 10 is a block diagram illustrating the configuration of the electro-optical device according to a modification example 1.

FIG. 10 is a block diagram illustrating a configuration of an electro-optical device 1A according to the modification example. In FIG. 10, the same reference numerals are given to the components which FIG. 10 has in common with FIG. 1, and the description is omitted. The electro-optical device 1A is different from the electro-optical device 1 in that the electro-optical device 1A has a compensation circuit 80 that performs compensation on the grayscale level of the even-numbered row image data Db2, in addition to the compensation circuit 40 that performs compensation on the grayscale level of the odd-numbered row image data Db1. The operation of the compensation circuit 80 is the same as the operation of feed-through 40 described referring to FIG. 7. The compensation circuit 80 performs compensation, in such a manner that the grayscale level of the even-numbered row image data Db2 that is input is increased in one (for example, the negative polarity writing) of the positive polarity writing and the negative polarity writing and is decreased in the other one (for example, the positive polarity writing) and supplies the result as the image data Dc2, on which compensation is performed, to the second D/A conversion circuit 60. Moreover, the direction in which the voltage signal Vid2 that is produced as a result of the compensation circuit 80 performing compensation on the grayscale level of the even-numbered row image data Db2 and is output from the second D/A conversion circuit 60 is shifted is not necessarily the same as the direction in which the voltage signal Vid1 that is produced as a result of the compensation circuit 40 performing compensation on the grayscale level of the even-numbered row image data Db1 and is output from the first D/A conversion circuit 50 is shifted.

Figure 11:
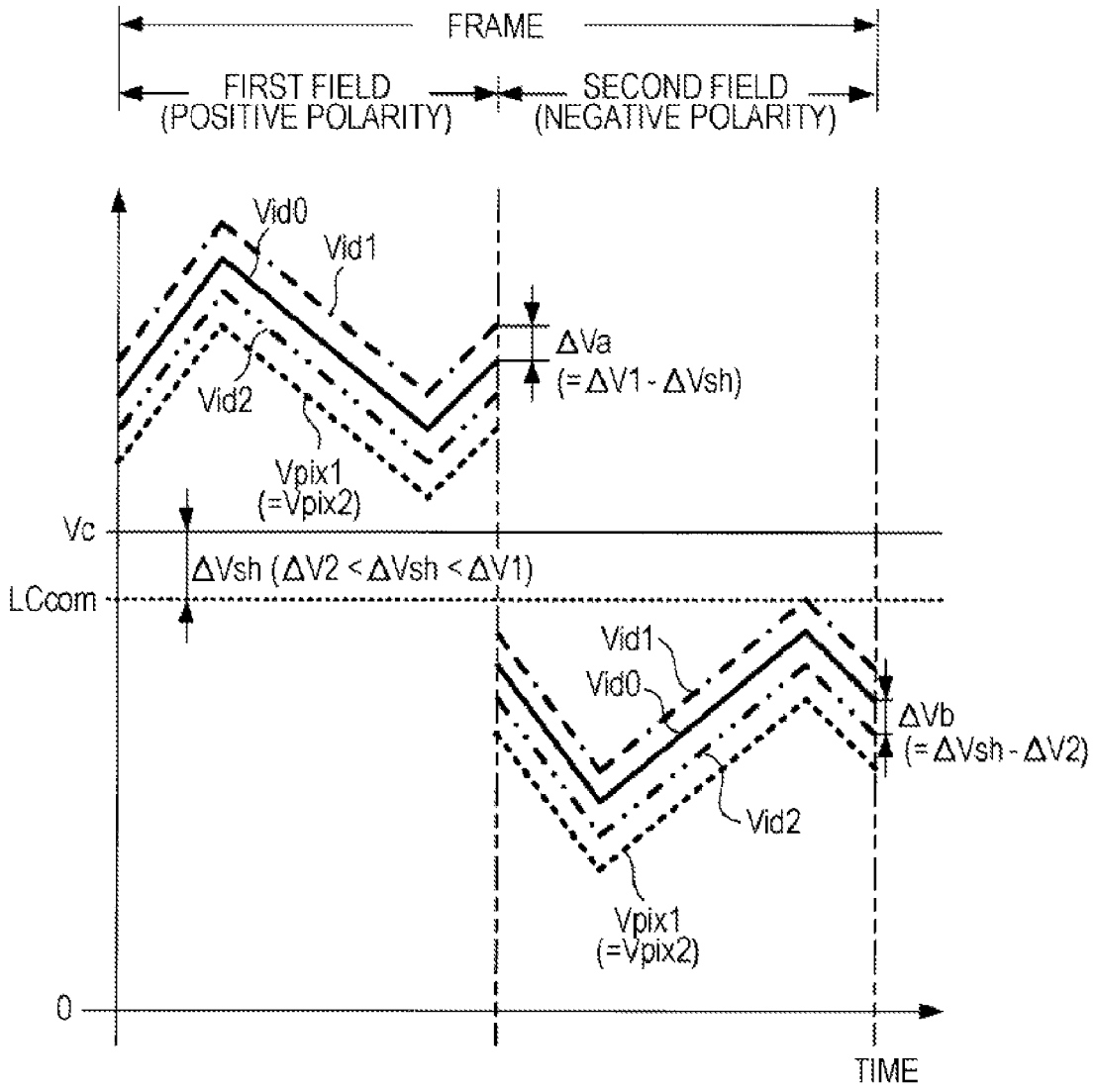
FIG. 11 is a view illustrating the voltage of each component of the electro-optical device according to the modification example 1 in a case of performing compensation in the compensation circuit.

FIG. 11 is a view to describe the voltage of each component of the electro-optical device 1A according to the modification example 1 in the case of performing compensation in the compensation circuits 40 and 80. In the example of FIG. 11, the display panel 100 has voltage displacement characteristics as illustrated in FIG. 6 (that is, the voltage displacement in the odd-numbered row ΔV1 and the voltage displacement in the even-numbered row ΔV2 (ΔV1>ΔV2)). Furthermore, for the sake of brevity of description, the odd-numbered row image data Db1 and the even-numbered row image data Db2 are defined as being the same, and the voltage signal obtained by causing the first D/A conversion circuit 50 or the second D/A conversion circuit 60 to convert that image data is expressed as the voltage signal Vid0 and is indicated as a solid line in FIG. 11. In the example of FIG. 11, the voltage LCcom of the common electrode 108 is set to a value greater than the amplitude center (that is, Vc−ΔV1) of the pixel voltage Vpix1 in the odd-numbered row in a case where compensation is not performed by the compensation circuit 40, and smaller than the amplitude center (that is, Vc−ΔV2) of the pixel voltage Vpix2 in the even-numbered row in a case where compensation is not performed by the compensation circuit 80. That is, when the deviation of the voltage LCcom of the common electrode 108 from the polarity reference voltage Vc is defined as ΔVsh, the voltage LCcom is set in such a manner as to be ΔV2<ΔVsh<ΔV1.

In this case, the compensation circuit 40 performs compensation with respect to the odd-numbered row image data Db1, in such a manner that the voltage signal Vid1 (indicated as a dashed dotted line in FIG. 11) output from the first D/A conversion circuit 50 is increased only by ΔVa=ΔV1−ΔVsh with respect to the voltage signal Vid0 output from the first D/A conversion circuit 50 in a case where compensation is not performed in the compensation circuit 40. That is, in the same manner as illustrated in the graph on the left-hand side of FIG. 7, compensation is performed to shift the odd-numbered row image data Db1 in the direction of increasing the grayscale level at the time of the positive polarity writing (the first field), and to shift the odd-numbered row image data Db1 in the direction of decreasing the grayscale level at the time of the negative polarity writing (the second field), and the image data Dc1, on which compensation is performed, is supplied to the first D/A conversion circuit 50. On the one hand, the compensation circuit 80 performs compensation with respect to the even-numbered row image data Db2, in such a manner that the voltage signal Vid2 (indicated as a dashed dotted line in FIG. 11) output from the second D/A conversion circuit 60 is decreased only by ΔVb=ΔVsh−ΔV2 with respect to the voltage signal Vid0 output from the second D/A conversion circuit 60 in a case where compensation is not performed in the compensation circuit 80. That is, in the manner opposite what is illustrated on the graph on the left-hand side of FIG. 7, compensation is performed to shift the even-numbered row image data Db2 in the direction of decreasing the grayscale level at the time of the positive polarity writing (the first field), and to shift the odd-numbered row image data Db2 in the direction of increasing the grayscale level at the time of the negative polarity writing (the second field), and the image data Dc2, on which compensation is performed, is supplied to the second D/A conversion circuit 60.

In the display panel 100 in the present example, the pixel voltage Vpix1 written into the pixel electrode 118 of the pixels 110 in the odd-numbered row becomes a voltage that is a result of the voltage signal Vid1 output from the first D/A conversion circuit 50 being decreased only by the voltage displacement ΔV1, and according to this, the amplitude center Vc1 of the pixel voltage Vpix1 is decreased only by the voltage displacement ΔV1 from the amplitude center of the voltage signal Vid1. As described above, the amplitude center Vc1 of the pixel voltage Vpix1 is smaller than the voltage LCcom of the common electrode 108, when compensation is not performed by the compensation circuit 40, because the voltage displacement ΔV1 is greater than the deviation ΔVsh of the voltage LCcom of the common electrode 108 from the polarity reference voltage Vc. Furthermore, in the display panel 100 in the present example, the pixel voltage Vpix2 written into the pixel electrode 118 of the pixels 110 in the even-numbered row becomes a voltage that is a result of the voltage signal Vid2 output from the second D/A conversion circuit 60 being decreased only by the voltage displacement ΔV2, and according to this, the amplitude center Vc2 of the pixel voltage Vpix2 is decreased only by the voltage displacement ΔV2 from the amplitude center of the voltage signal Vid2. As described above, the amplitude center Vc2 of the pixel voltage Vpix2 is greater than the voltage LCcom of the common electrode 108, when compensation is not performed by the compensation circuit 80, because the voltage displacement ΔV2 is smaller than the deviation ΔVsh of the voltage LCcom of the common electrode 108 from the polarity reference voltage Vc. In the present example, due to the operation of the compensation circuit 40, the voltage signal Vid1 output from the first D/A conversion circuit 50 is increased in advance only by ΔVa=ΔV1−ΔVsh with respect to the voltage signal Vid0 output from the first D/A conversion circuit 50 in a case where compensation is not performed in the compensation circuit 40, and due to the operation of the compensation circuit 80, the voltage signal Vid2 output from the second D/A conversion circuit 60 is decreased in advance only by ΔVb=ΔVsh−ΔV2 with respect to the voltage signal Vid0 output from the second D/A conversion circuit 60 in a case where compensation is not performed in the compensation circuit 80. Because of this, all of the amplitude center Vc1 of the pixel voltage Vpix1 in the odd-numbered row and the central voltage Vc2 of the pixel voltage Vpix2 in the even-numbered row agrees with the voltage LCcom of the common electrode 108. Therefore, in any one of the pixel 110 in the odd-numbered row and the pixel 110 in the even-number row, the direct current voltage component does not act on the liquid crystal 105.

MODIFICATION EXAMPLE 2

In the embodiment described above, the electro-optical device 1 has the compensation circuit 40 that performs compensation on the grayscale level of the odd-numbered row image data Db1, but the invention is not limited to this configuration. The electro-optical device 1 may adjust the compensation amount (also referred to as an offset value) of the direct current component of the voltage signal output from the first D/A conversion circuit 50 and/or the second D/A conversion circuit 60, using an analog process.

Figure 12:
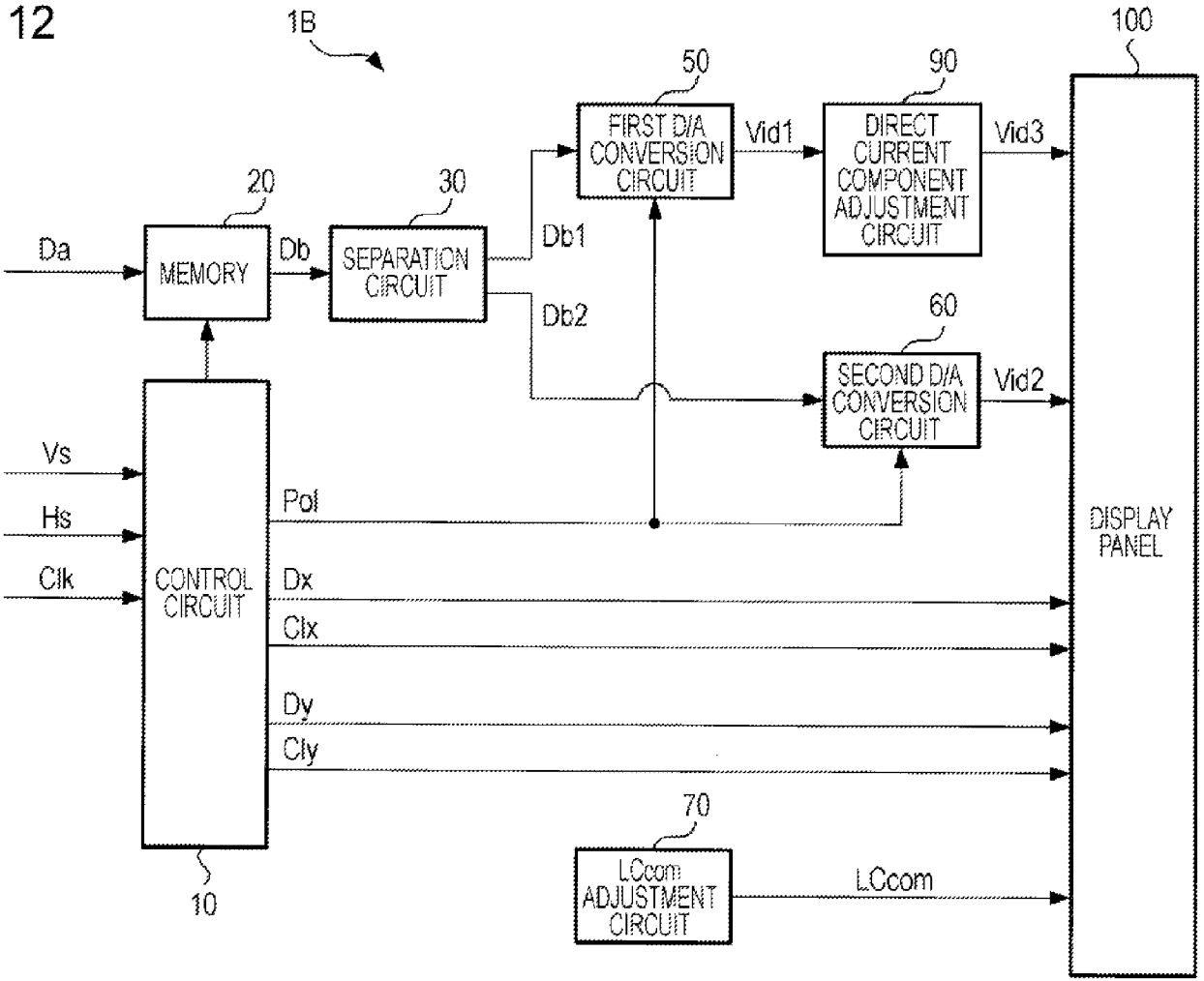
FIG. 12 is a block diagram illustrating the configuration of the electro-optical device according to a modification example 2.

FIG. 12 is a block diagram illustrating a configuration of an electro-optical device 1B according to the modification example 2. In FIG. 12, the same reference numerals are given to the parts which FIG. 12 has in common with FIG. 1, and the description is omitted. Instead of the compensation circuit 40 performing compensation on the grayscale level of the odd-numbered row image data Db1, the electro-optical device 1B illustrated in FIG. 12 is provided on the downstream side of the first D/A conversion circuit 50. The electro-optical device 1B differs from the electro-optical device 1 illustrated in FIG. 1 in that the electro-optical device 1B has a direct current component adjustment circuit 90 adjusting the size of the direct current component of the voltage signal Vid1 output from the first D/A conversion circuit 50. The direct current component adjustment circuit 90 is equivalent to one example of a compensation unit according to the invention.

The direct current component adjustment circuit 90 adjusts the direct current component of the voltage signal Vid1 in such a manner that the voltage signal Vid1 output from the first D/A conversion circuit 50 is increased or decreased in any one of the first field (the positive polarity writing) and the second field (the negative polarity writing), and supplies the post-adjustment voltage signal as the voltage signal Vid3 to the display panel 100. Accordingly, in the same manner as in the embodiment described above, when the voltage LCcom of the common electrode 108 is adjusted according to the pixels 110 in the even-numbered row, the deviation between the amplitude center Vc1 of the pixel voltage Vpix1 in the odd-numbered row and the voltage LCcom of the common electrode 108 may be reduced.

In this manner, the compensation unit according to the invention may have a compensation circuit that is provided on the upstream side of the D/A conversion circuit, and that performs compensation on the voltage applied to the pixels 110 of the display panel 100, using a digital process, and may have a direct current component adjustment circuit that is provided on the downstream side of the D/A conversion circuit, and that performs compensation, using the analog process. However, in a case where compensation is performed using the digital process, compensation is easy to perform with high precision.

MODIFICATION EXAMPLE 3

The first data line drive circuit 140 that supplies the data signals X1*a*, X2*a*, X3*a* and so forth to Xna to the pixels 110 in the odd-numbered row and the second data line drive circuit 150 that supplies the data signals X1*b*, X2*b*, X3*b* and so forth to Xnb to the pixels 110 in the even-numbered row are provided in the embodiment described above, but the invention is not limited to this configuration. The data signals X1*a*, X2*a*, X3*a* and so forth to Xna in the pixels in the odd-numbered row and the data signals X1*b*, X2*b*, X3*b* and so forth to Xnb in the pixels in the even-numbered row may be supplied from one data line drive circuit. In that case, the separation circuit 30 and the second D/A conversion circuit 60 that are illustrated in FIG. 1, may be removed.

Figure 13:
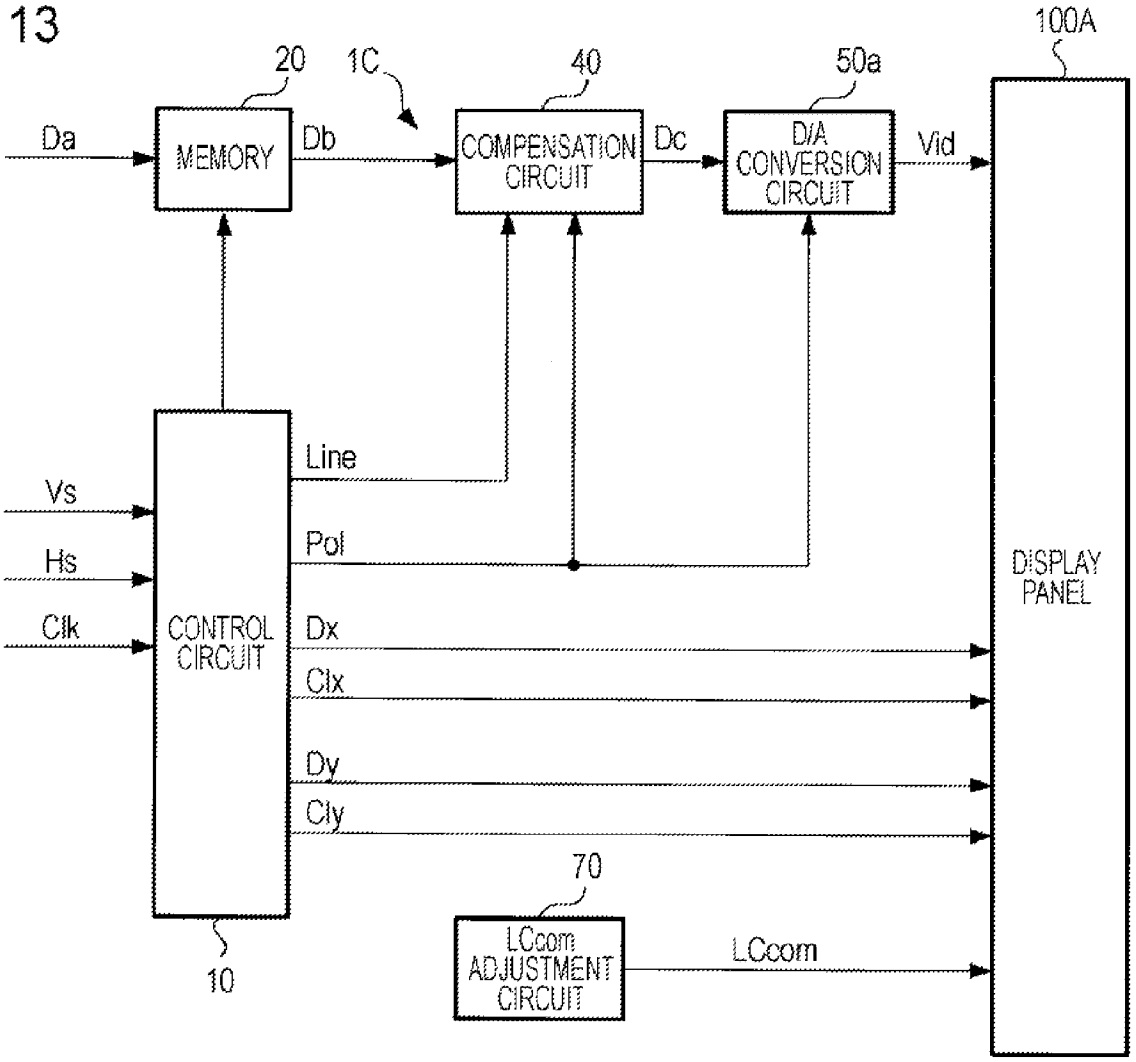
FIG. 13 is a block diagram illustrating the configuration of the electro-optical device according to a modification example 3.
Figure 14:
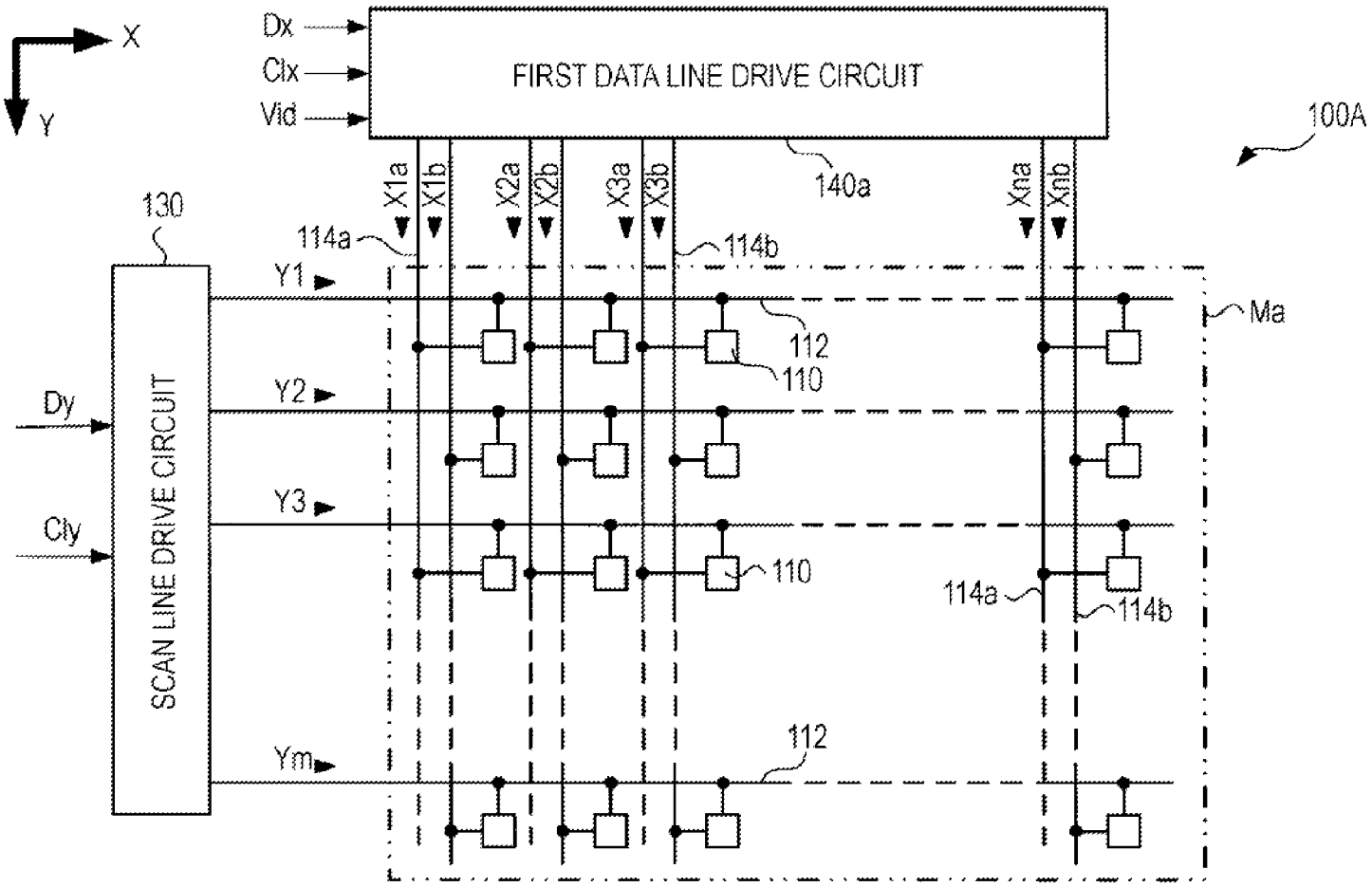
FIG. 14 is a view illustrating the configuration of the display panel according to the modification example 3.

FIG. 13 is a block diagram illustrating a configuration of an electro-optical device 1C according to the modification example 3. In FIG. 13, the same reference numerals are given to the parts which FIG. 13 has in common with FIG. 1, and the description is omitted. FIG. 14 is a view illustrating a configuration of a display panel 100A according to the modification example 3. In FIG. 14, the same reference numerals are given to the parts which FIG. 14 has in common with FIG. 2, and the description is omitted.

The electro-optical device 1C illustrated in FIG. 13 does not have the separation circuits 30 and the second D/A conversion circuit 60, and differs from the electro-optical device 1 illustrated in FIG. 1 in that the image data Db before being divided into the odd-numbered row image data Db1 and the even-numbered row image data Db2 is input to the compensation circuit 40. Furthermore, in the electro-optical device 1C illustrated in FIG. 13, a signal Line expressing whether the image data Db that is input to the compensation circuit 40 corresponds to the pixel 110 in the even-numbered row or corresponds to the pixel 110 in the odd-numbered row is input from the control circuit 10 to the compensation circuit 40. For example, as described above, in a case where the voltage LCcom of the common electrode 108 of the display panel 100 is set in such a manner as to be an optimal value with respect to the pixels 110 in the even-numbered row, the compensation circuit 40 does not perform the compensation process when the signal Line expresses that the image data Db corresponds to the pixel 110 in the even-numbered row and performs the compensation process described referring to FIG. 7, with reference to a signal Pol when the signal Line expresses that the image data Db corresponds to the pixel 110 in the odd-numbered row. The output of the feed-through 40 is supplied to D/A conversion circuit 50*a* as the image data Dc, then is converted to the voltage signal Vid in the D/A conversion circuit

50*a*, and the result is inputted to the display panel 100. Therefore, the data signal of the pixels 110 in the odd-numbered row and the data signal of the pixels 110 in the even-numbered row are included in the voltage signal Vid.

The display panel 100A illustrated in FIG. 14 differs from the display panel 100 illustrated in FIG. 2, in that the display panel 100A has the data line drive circuit 140*a* that is common to the pixels 110 in the odd-numbered row and the pixels 110 in the even-numbered row. The voltage signal Vid that is output from a D/A conversion circuit 50*a* and that includes the data signal of the pixels 110 in the odd-numbered row and the data signal of the pixels 110 in the even-numbered row is input to a data line drive circuit 140*a*. The scan line drive circuit 130 is synchronized with the voltage signal Vid and supplies the scan signals Y1, Y2, Y3, and so forth to Ym to the scan lines 112 in the first, second, third and so forth to m-th rows, respectively. Since the data signal of the pixels 110 in the odd-numbered row and the data signal of the pixels 110 in the even-numbered row are included in the voltage signal Vid in the present example, the writing of the data into the pixel 110 connected to the scan lines 112 (the horizontal scanning) may not be concurrently performed by concurrently selecting the scan line 112 in the odd-numbered row and the scan line 112 in the even-numbered row. However, for example, by the data line 114*a* for the pixels 110 in the odd-numbered row and the data line 114*b* for the pixels 110 in the even-numbered row being provided on the different wire layers, a situation may occur in which the optimal voltage LCcom of the common electrode 108 differs in the pixel 110 in the odd-numbered row and the pixel 110 in the even-numbered row, such as when the voltage reduction due to the feed-through of the selection transistor 144 is different in size. As described above, the compensation circuit 40 makes the difference small in the optimal voltage LCcom of the common electrode 108 between the pixels 110 in the odd-numbered row and the pixels 110 in the even-numbered row, by performing compensation on at least one of the odd-numbered row image data (Db1) and the even-numbered row image data (Db2) included in the image data Db. Accordingly, the display defects, such as flickering and screen burn in the electro-optical device 1 are reduced.

MODIFICATION EXAMPLE 4

The embodiment described above has the configuration in which one frame is divided into the first field and the second field, and the positive polarity writing and the negative polarity writing are performed, respectively, but the invention is not limited to this configuration. One frame, when taken as an example, may be divided into 4 or more even-numbered fields and the positive polarity writing and the negative polarity writing may be alternately performed. Furthermore, for example, the frames may be categorized as odd-numbered frames and even-numbered frames instead of the frame being divided into fields, and the positive polarity writing and the negative polarity writing may be alternately performed.

OTHER MODIFICATION EXAMPLE

The electronic apparatus according to the invention is not limited to the projector. The invention may be used in, for example, an apparatus equipped with a television, viewfinder-type and monitor-direct-viewing-type video recorders, a car navigation device, a pager, an electronic notebook, a calculator, a word processor, a workstation, a videophone, a POS terminal, a digital still camera, a portable telephone, and a touch panel. Furthermore, in the example described above, the projector is the three-panel projector that uses three light valves 100R, 100G, and 100B, but the invention is not limited to this configuration. The projector may be a single panel projector that uses one color display panel having the pixel of each of the RGB colors. That is, the electro-optical device according to the invention may include the color display panel having the pixel of each of the RGB colors. Furthermore, in the embodiment described above, the liquid crystal capacity 120 is not limited to a transmission type, but may be a reflection type. Additionally, the liquid crystal capacity 120 is not limited to a normally black mode, but for example as a TN method may employ a normally white mode in which the liquid crystal capacity 120 is in a white state when applying no voltage.

This application claims priority to Japan Patent Application No. 2011-244481 filed Nov. 8, 2011, the entire disclosures of which are hereby incorporated by reference in their entireties.

What is claimed is:

1. An electro-optical device comprising:

a first pixel group having a first plurality of pixel electrodes in which a first voltage is written into each pixel electrode of the first pixel group via a first wiring in a first path;

a second pixel group having a second plurality of pixel electrodes in which a second voltage is written into each pixel electrode of the second pixel group via a second wiring in a second path, the second wiring arranged in a different layer from the first wiring in a display area via an insulator;

a common electrode that is common to the first pixel group and the second pixel group; and a compensation unit that performs compensation for at least one of the first voltage and the second voltage, wherein the first plurality of pixel electrodes, the second plurality of pixel electrodes, the first wiring in the first path, and the second wiring in the second path are disposed on a first substrate in a display area, the common electrode is disposed on a second substrate opposed to the first substrate, and the compensation unit performs compensation in such a manner as to reduce a difference between a first optimal voltage of the common electrode with respect to the first pixel group and a second optimal voltage of the common electrode with respect to the second pixel group, the difference between the first optimal voltage and the second optimal voltage originating from a result that the first wiring in the first path and the second wiring in the second path are arranged in different layers in the display area via an insulator.

2. The electro-optical device according to claim 1, wherein the first wiring in the first path and the second wiring in the second path are driven by different drive circuits.

3. The electro-optical device according to claim 1, wherein the compensation unit comprises:

a compensation circuit that performs the compensation for the at least one of the first voltage and the second voltage on image data determining a grayscale level of at least one of the first pixel group and the second pixel group; and a D/A converter that performs D/A conversion on the image data on which the compensation is performed by the compensation circuit and generates at least one of the first voltage to be supplied to the first pixel group and the second voltage to be supplied to the second pixel group.

4. An electronic apparatus comprising an electro-optical device according to claim 1.

5. The electro-optical device of claim 1, further comprising:

another plurality of pixel electrodes arranged in a matrix configuration including a plurality of rows and a plurality of columns, wherein the another plurality of pixel electrodes includes the first plurality of pixel electrodes of the first pixel group and the second plurality of pixel electrodes of the second pixel group, and the first pixel group and the second pixel group are arranged in a same column of the plurality of columns.

6. The electro-optical device according to claim 1, wherein the compensation unit performs the compensation to shift the image data in a direction of increasing a grayscale level in a positive polarity writing and in a direction of decreasing a grayscale level in a negative polarity writing, so that the first voltage is shifted in the positive polarity writing and in the negative polarity writing by a value $\Delta V$ that is a difference between a voltage displacement of the first voltage and a voltage displacement of the second voltage.

* * * * *